US005170185A

United States Patent [19]

Takemura et al.

[11] Patent Number: 5,170,185

[45] Date of Patent: Dec. 8, 1992

[54] IMAGE FORMING APPARATUS

[75] Inventors: Osamu Takemura, Nishinomiya; Takahiko Kimura, Ikoma; Masaaki Yukawa, Osaka, all of Japan

[73] Assignee: Mita Industrial Co., Ltd., Osaka, Japan

[21] Appl. No.: 708,138

[22] Filed: May 30, 1991

[30] Foreign Application Priority Data

May 30, 1990 [JP] Japan ..... 2-142656

[51] Int. Cl.[5] ..... B41J 2/005; B41J 2/415

[52] U.S. Cl. ..... 346/140 R; 346/159

[58] Field of Search ..... 346/140 R, 153.1, 159; 101/DIG. 37

[56] References Cited

U.S. PATENT DOCUMENTS

| | | | |
|---|---|---|---|
| 3,625,604 | 12/1971 | Pressman | 355/219 |
| 3,689,935 | 9/1972 | Pressman et al. | 346/159 |
| 4,491,855 | 1/1985 | Fujii et al. | 346/159 |
| 4,912,489 | 3/1990 | Schmidlin | 346/159 |
| 4,943,818 | 7/1990 | Hotomi | 346/140 R |
| 4,956,670 | 9/1990 | Masuda et al. | 346/159 X |

FOREIGN PATENT DOCUMENTS

| | | |
|---|---|---|
| 345024 | 12/1989 | European Pat. Off. . |
| 410738 | 1/1991 | European Pat. Off. . |
| 62-176873 | 8/1987 | Japan . |
| 0287568 | 11/1990 | Japan . |
| 0057658 | 3/1991 | Japan . |

*Primary Examiner*—Benjamin R. Fuller
*Assistant Examiner*—Alrick Bobb
*Attorney, Agent, or Firm*—Nikaido, Marmelstein, Murray & Oram

[57] ABSTRACT

An image forming apparatus is provided, in which a plurality of toner passage holes are formed in a board, and an image information generator applies a voltage between a pair of electrodes to form an electric field within each toner passage hole, so as to pass toner through the toner passage hole. The diameter and the axial length of each toner passage hole are so determined as to avoid clogging with toner.

38 Claims, 14 Drawing Sheets

Fig.3
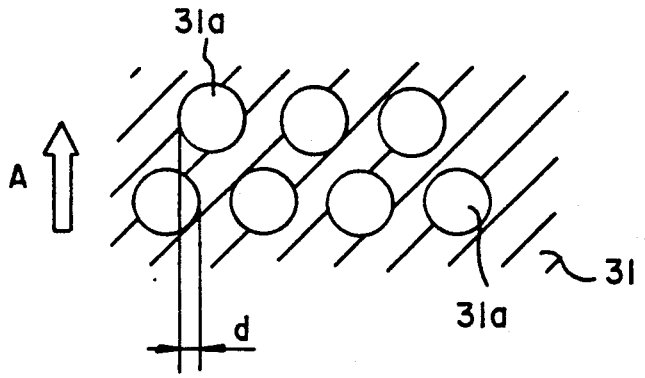
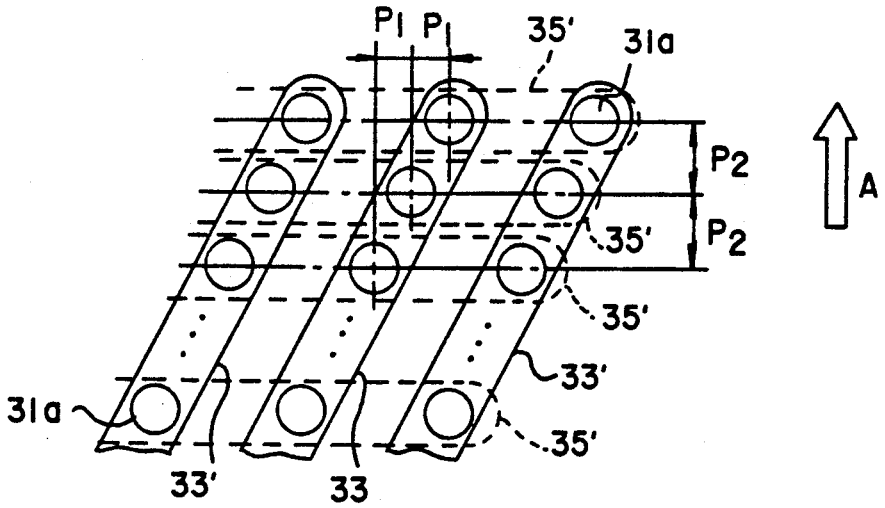
Fig.5

Fig.9
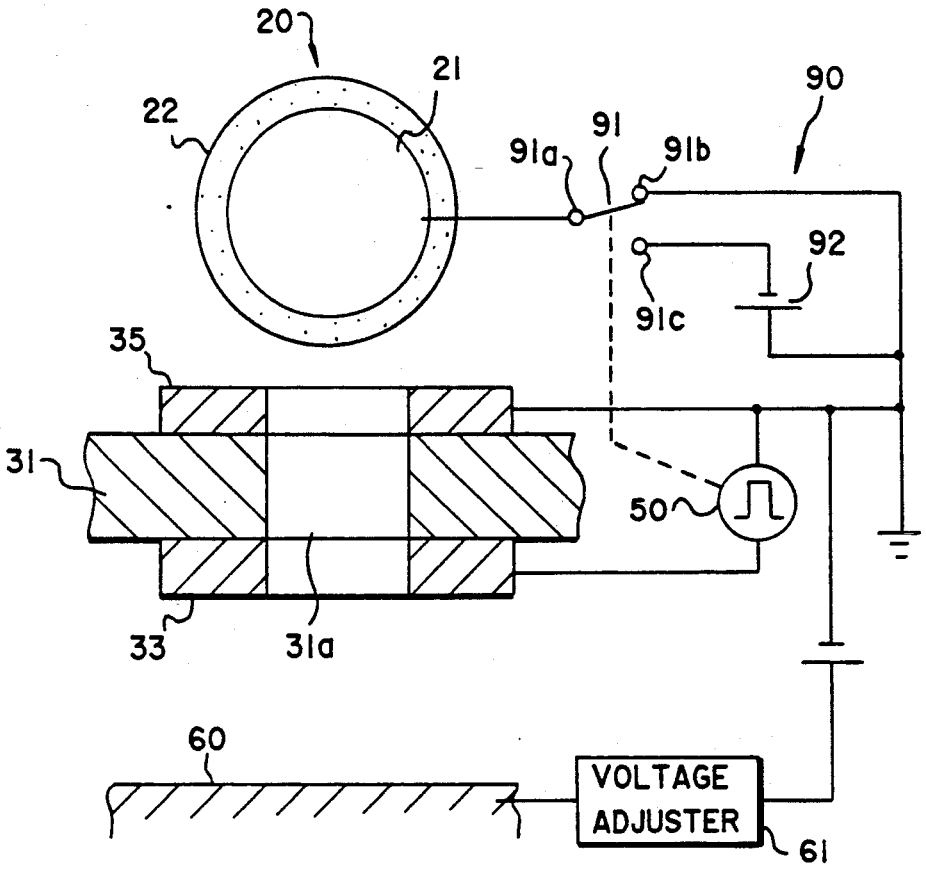
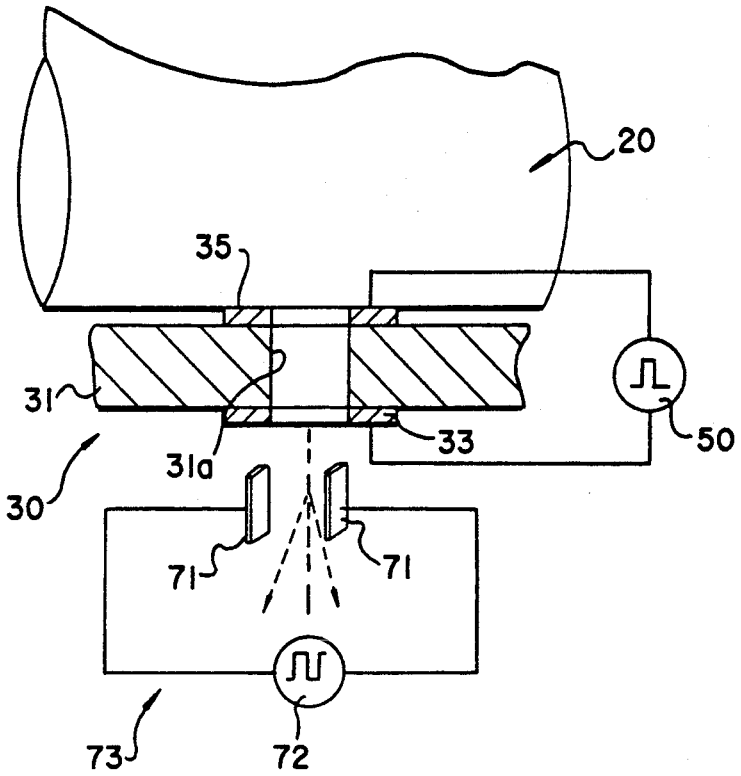
Fig.10

Fig.12a
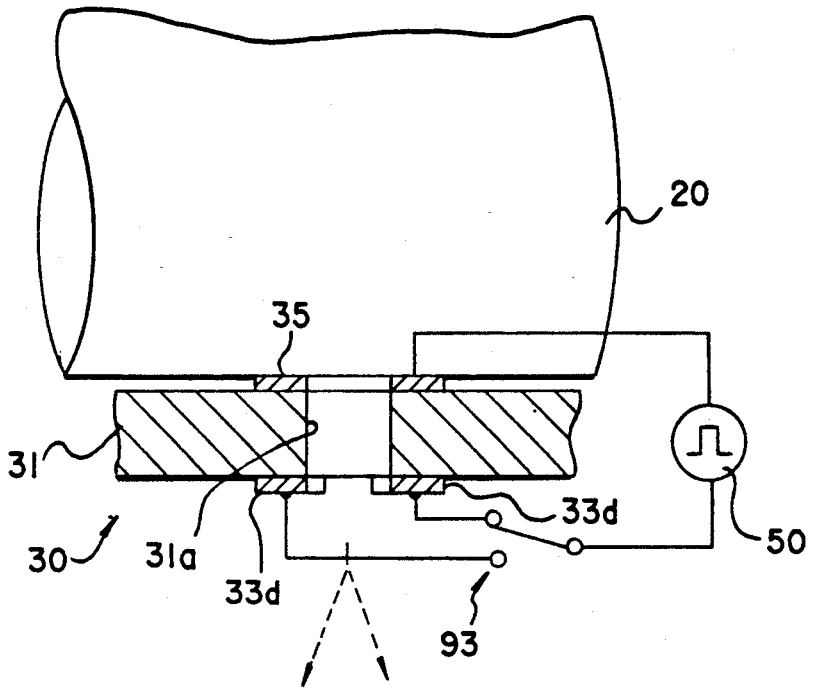
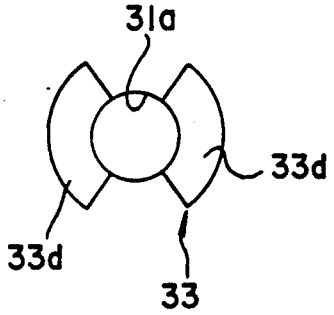
Fig.12b

Fig.14a
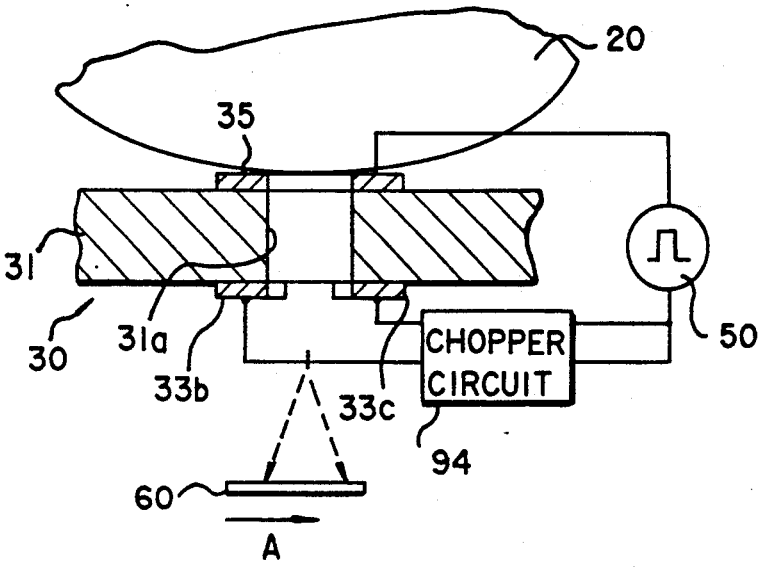
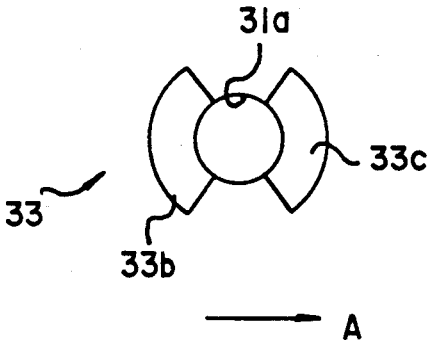
Fig.14b

Fig.19
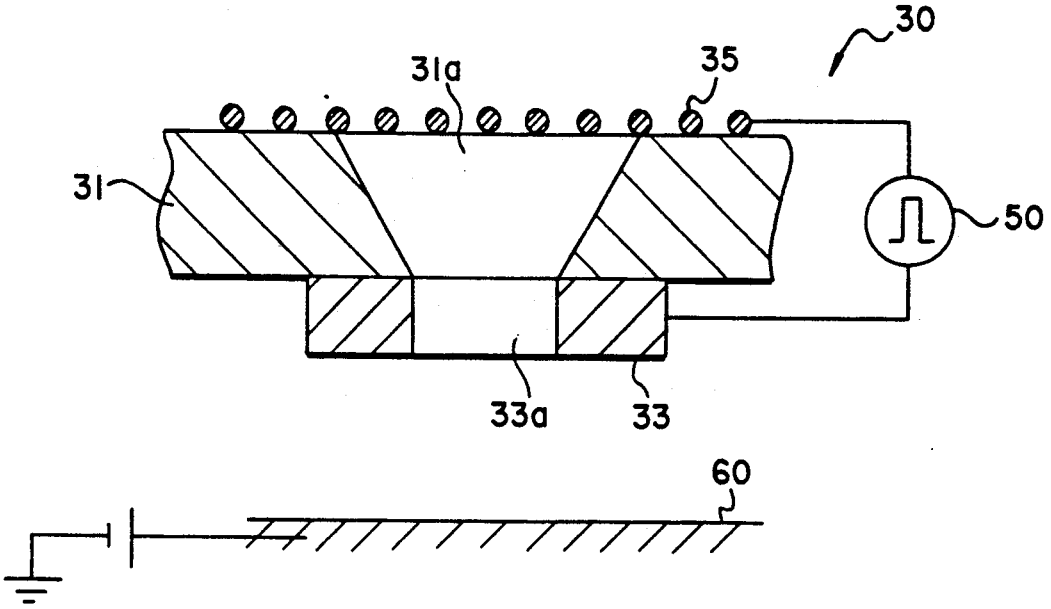
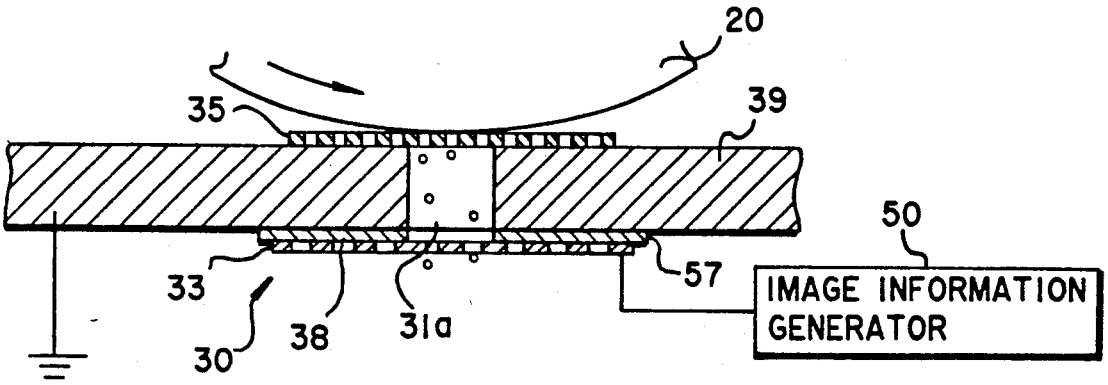
Fig.22

Fig.20
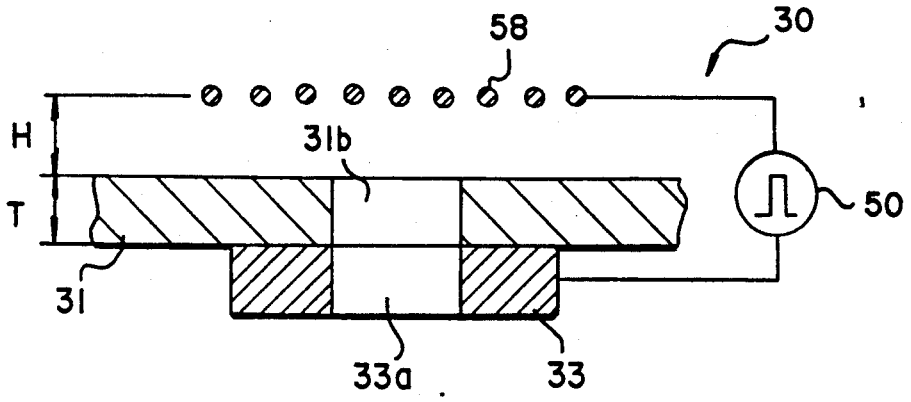
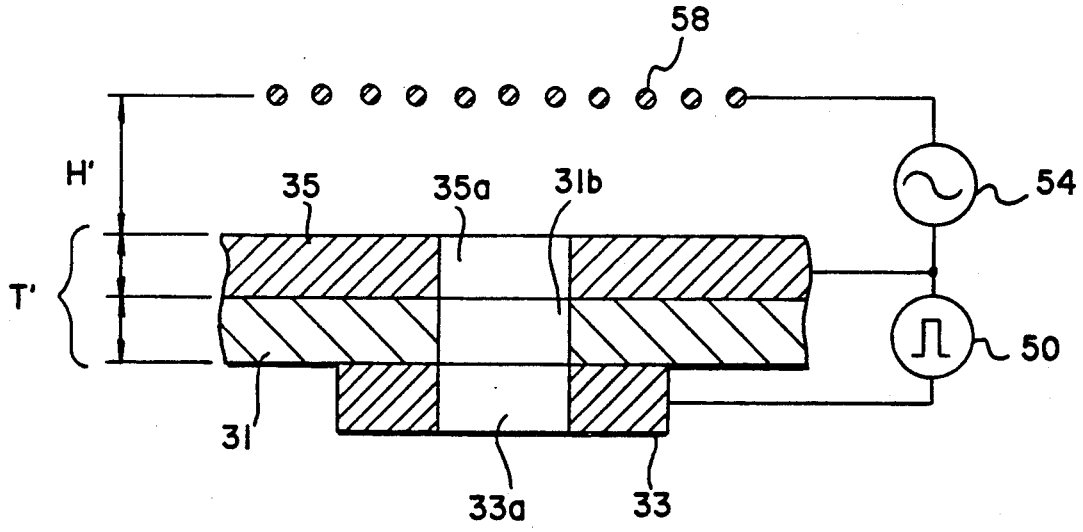
Fig.21

IMAGE FORMING APPARATUS

BACKGROUND OF THE INVENTION

1. Field of the Invention

The present invention relates to an image forming apparatus using powdered toner.

2. Description of the Prior Art

It is known how to provide an image forming method using an ink jet printer for word processors, facsimile machines, computers, etc.

The ink jet printer is a typical example of the so-called nonimpact printer. In the ink jet printer, pressure is applied to a prescribed liquid ink by means of a piezoelectric element or the like which produces ultrasonic vibrations so that the liquid ink is discharged from an ink nozzle into a prescribed electric field, the ink droplets being controlled by the electric field and deposited onto a recording paper to form an image thereon. Such an ink jet printing method has the advantage that a clear image can be formed without generating noise during the formation of the image. On the other hand, this method involves disadvantages in that it requires the use of a special kind of paper with surface treatment, etc. in order to control the speed at which the ink penetrates into the recording paper and also in that the nozzle tends to become clogged with foreign matters and other particles contained in the ink as the ink is supplied through the nozzle.

To overcome the above problems with the ink jet printer, an image forming apparatus using powdered toner as an image recording medium has been disclosed, for example, in Japanese Laid-Open Patent Publication No. 62-176873. This image forming apparatus is provided with a toner control means which performs control in such a manner that particles of powdered toner charged with a prescribed polarity are made to pass through pinhole-like toner passage holes by means of an electrostatic attraction force generated in response to an image output signal. The toner control means works to selectively apply toner particles to the recording paper to form the required image thereon. In such an apparatus, plain paper can be used as the recording paper, and also, since fine powdered toner is used, the toner passage holes are prevented from becoming clogged.

The toner control means for controlling the distribution of the powdered toner includes a board having numerous pinhole-like toner passage holes and a pair of electrodes insulated from each other disposed across the board so as to form an electric field within each toner passage hole. The paired electrodes are each provided with pinhole-like throughholes of the same size as that of the toner passage holes and are mounted on the respective sides of the board in such a manner that the throughholes are aligned with the toner passage holes. When a prescribed voltage is applied between the two electrodes and an electric field is formed along a prescribed direction within the corresponding toner passage hole, toner particles are made to pass through the toner passage hole. On the other hand, when toner particles are to be prevented from passing through the toner passage hole, a prescribed voltage is applied between the two electrodes in such a manner that an electric field is formed along the direction opposite to that of the electric field formed to allow toner particles to pass through the toner passage hole. The toner passed through the toner passage hole in the insulating board is deposited on the recording paper, placed suitably spaced apart from the insulating board, to form a dot thereon. Numerous toner dots combine to form an image on the recording paper.

The board in which the numerous pinhole-like toner passage holes are formed is usually made of plastic, while the electrodes are formed by bonding aluminum sheets having numerous pinhole-like through-holes in such a manner that the throughholes are aligned with the toner passage holes formed in the insulating board.

In recent years, there has been a demand for an image forming apparatus capable of forming high quality images, and therefore, there has arisen a need to make toner passage holes of a smaller diameter. Using toner passage holes of a smaller diameter, the resulting dots can be formed with a smaller diameter. However, when the toner passage holes are made smaller in diameter, there arises a possibility that the toner passage holes may become clogged with toner. To prevent this, the insulating board may be reduced in thickness, thereby reducing the axial length of each toner passage hole.

However, since a pair of electrodes are provided on the insulating board in order to form a prescribed electric field in each toner passage hole, an insulating board in which numerous toner passage holes are formed is required to have a prescribed dielectric strength as well as a mechanical strength. It is therefore not an easy job to reduce the thickness of the insulating board.

Furthermore, in such an image forming apparatus, ultrasonic vibrations are applied to the insulating board, in which case the pinhole-like toner passage holes formed in the insulating board can be prevented from becoming clogged. However, in the case of toner passage holes of extremely small diameter, it is not possible to completely prevent them from becoming clogged with toner.

Also, when the insulating board to which ultrasonic vibrations are applied is made of plastic, there is another problem that the ultrasonic vibrations may not be sufficiently transferred through the board. Therefore, in the case of a plastic board, there is a possibility that lumps of toner supplied may not be sufficiently broken up into fine particles. If the lumps of toner are not sufficiently broken up, the pinhole-like toner passage holes will become clogged with toner. Even if the ultrasonic vibrations are sufficiently transferred, fine particles of toner may adhere to the pinhole-like toner passage holes over a long period of use of the image forming apparatus, eventually causing the toner passage holes to be clogged with toner. When the toner passage holes are clogged with toner, the image quality will be substantially degraded, causing such troubles as white spots in the image formed on the recording paper.

Furthermore, there is the problem that it is not easy to bond the electrodes formed from aluminum sheets to the insulating board in such a manner that the pinhole-like throughholes formed in the aluminum sheets are aligned with the pinhole-like toner passage holes formed in the insulating board.

Also, since the recording paper onto which the toner is to be applied is placed at a suitable distance from the insulating board, there is a possibility that the toner passed through the toner passage holes in the board may radially spread before reaching the recording paper. If this happens, the toner passed through each toner passage hole adheres to the recording paper taking a larger area than the diameter of the toner passage hole and thus interfering with the formation of a clear image on the recording paper.

Normally, an image with clearer edges can be formed on the recording paper when the dot diameter of toner is smaller. Therefore, in the case of an image requiring production with clearer edges, such as characters, a smaller dot diameter is desirable. On the other hand, with a larger dot diameter, gradations of tone can be given to the edges of an image formed on the recording paper; therefore, in the case of an image having gradations in tone, such as photographs, a larger dot diameter is desirable. However, since the toner passage holes formed in the board each have a fixed bore diameter, the dot diameter cannot be adjusted, and therefore, it is not possible to adjust the image quality according to the image to be formed.

The toner supplied to the toner control means is usually charged with a prescribed polarity. However, when toner particles charged with opposite polarity are contained in the toner supplied to the toner control means, the toner particles of the opposite polarity are moved in the opposite direction from the toner charged with the prescribed polarity by the toner control means. As a result, the toner particles charged with opposite polarity are passed through the toner passage holes and adhere to the recording paper when it is not necessary to form an image. This will result in the fogging of the image formed on the recording paper.

Further, the amount of toner passing through each toner passage hole is usually fixed. If the image density is to be adjusted, digital processing such as the dither method will be required, which will complicate the construction of the image forming apparatus. Therefore, the problem is that the image density cannot be changed easily when there occurs a variation in the image density due to changes in the environmental conditions such as temperature, humidity, etc.

Usually, the numerous toner passage holes are arranged in arrays each extending substantially perpendicular to the advancing direction of the recording paper. Therefore, in order to form a continuous line or an image having a substantial area, it is necessary to form the dots overlapping each other. Each individual dot is formed by the toner passed through each toner passage hole, while on the other hand, the toner passage holes are arranged suitably spaced apart from each other. Therefore, in order to form adjacent dots overlapping each other, the dot diameter must be made larger than the diameter of each toner passage hole. To make the dot diameter larger, the amount of toner passed through the toner passage hole must be increased. This requires decreasing the recording paper transport speed, which causes the problem that the image forming speed is decreased. Furthermore, when the dot diameter is made larger, the density in the periphery of the dot decreases, preventing the formation of an image with sharp edges.

SUMMARY OF THE INVENTION

The image forming apparatus of this invention, which overcomes the above-discussed and numerous other disadvantages and deficiencies of the prior art, comprises toner control means including a board having at least one toner passage hole; and a pair of electrodes insulated from each other disposed across the board so as to form an electric field within the toner passage hole and having throughholes aligned in communicating relationship with the corresponding toner passage holes; ultrasonic vibration generating means for applying ultrasonic vibrations to the board; and image information generating means for providing in accordance with image information a potential difference between the paired electrodes of the toner control means so as to form within the toner passage hole an electric field exerting a force at least in the toner passing direction, wherein the relationship of the diameter a of the toner passage hole relative to the combined axial length b of the toner passage hole and the throughholes in the paired electrodes satisfies the condition of $5a \geqq b$.

In a preferred embodiment, the image forming apparatus further comprises a base electrode which is disposed on the toner exit side of the toner passage hole in the toner control means and on the upper surface of which a recording paper is transported in a prescribed direction, the base electrode, together with the electrode disposed on the toner entry side of the toner control means, serving to form an electric field exerting a force in the toner passing direction, wherein the distance c between the base electrode and the electrode on the toner exit side of the toner control means satisfies condition of $10a \geqq c$ with respect to the toner passage hole.

In a preferred embodiment, the board is an insulating board.

In a preferred embodiment, the board is formed from a glass fiber reinforced epoxy resin.

In a preferred embodiment, the board is formed from a photosensitive polymer.

In a preferred embodiment, the board is formed from polyimide.

In a preferred embodiment, the image forming apparatus further comprises voltage adjusting means for adjusting the voltage applied to the base electrode.

In a preferred embodiment, the image forming apparatus further comprises toner feed means for feeding toner charged with prescribed polarity to the toner control means.

In a preferred embodiment, the toner feed means is a sponge roller including a conductive metal roller part and a sponge layer fitted around the outer circumferential surface of the metal roller part.

In a preferred embodiment, the metal roller part of the sponge roller is charged with the same polarity as that of the charged toner supplied to the toner feed means.

In a preferred embodiment, the image forming apparatus further comprises vibration strength adjusting means for adjusting the strength of vibrations the ultrasonic vibration generating means generates.

In a preferred embodiment, the ultrasonic vibration generating means is operated when an image forming operation is not performed.

In a preferred embodiment, the board is supported, at the side edge thereof opposite across the portions of the toner passage holes from the side edge where the ultrasonic vibration generating means is mounted, by means of a prescribed supporting member with an elastic member interposed therebetween.

In a preferred embodiment, the ultrasonic vibration generating means is coupled to the board by means of a vibrating member formed from a material having good ultrasonic transmissibility.

In a preferred embodiment, the image forming apparatus further comprises an output time adjusting means for adjusting the time during which a prescribed potential is provided between the paired electrodes of the toner control means in response to the output of the image information generating means.

In a preferred embodiment, the image forming apparatus further comprises a signal potential adjusting means for adjusting the signal potential applied between the paired electrodes of the toner control means by the image information generating means.

In a preferred embodiment, the toner passage holes are provided in plural numbers and arranged in a plurality of arrays extending in the direction perpendicular to the advancing direction of the recording paper, the toner passage holes in each array overlapping each other in the advancing direction of the recording paper.

In a preferred embodiment, the image forming apparatus further comprises a means for increasing the potential difference between the paired electrodes of the toner control means when a signal to form an image is issued, as well as when a signal not to form an image is issued, from the image information generating means.

In a preferred embodiment, the voltage adjusting means for the base electrode is controlled according to a signal to form an image and a signal not to form an image issued from the image information generating means.

In a preferred embodiment, the image forming apparatus further comprises means for applying one potential to the metal roller part of the sponge roller when a signal to form an image is issued, and another potential thereto when a signal not to form an image is issued from the image information generating means.

In a preferred embodiment, the image forming apparatus further comprises toner deflecting means disposed between the toner control means and the base electrode for deflecting the toner passed through the toner passage hole toward a prescribed direction.

In a preferred embodiment, the toner deflecting means deflects the toner toward a direction perpendicular to the advancing direction of the recording paper.

In a preferred embodiment, the toner deflecting means includes a pair of electrodes disposed opposite to each other along a direction perpendicular to the advancing direction of the recording paper and means for applying to the electrodes a voltage varying in a pulse-like manner.

In a preferred embodiment, the toner deflecting means includes a pair of electrodes disposed opposite to each other along a direction perpendicular to the advancing direction of the recording paper and means for applying to the electrodes a voltage varying in a stepwise manner.

In a preferred embodiment, the toner deflecting means comprises a chopper circuit for applying a pulse voltage to a signal electrode which is split into two paired sectors along a direction perpendicular to the advancing direction of the recording paper.

In a preferred embodiment, the toner deflecting means deflects the toner toward the same direction as the advancing direction of the recording paper.

In a preferred embodiment, the toner deflecting means includes a pair of electrodes disposed opposite to each other along the advancing direction of the recording paper and means for applying to the electrodes a voltage varying in a sawtooth form.

In a preferred embodiment, the deflecting means comprises a chopper circuit for applying a pulse voltage to a signal electrode which is split into two paired sectors along the advancing direction of the recording paper.

In a preferred embodiment, the toner entry side electrode of the toner control means is provided with an insulating member on the surface thereof close to the toner feed means.

In a preferred embodiment, the insulating member is provided with an electrode mounted on the surface thereof close to the toner feeding means and an alternating voltage is applied between the electrodes disposed opposite to each other across the insulating member.

In a preferred embodiment of the pair of electrodes disposed opposite each other across the board, the toner entry side electrode is a mesh-like electrode.

In a preferred embodiment, the pair of electrodes disposed opposite to each other across the board are mesh-like electrodes.

In a preferred embodiment, the toner passage holes are each formed in a tapered shape becoming wider toward the open end thereof from which the toner enters.

In a preferred embodiment, the mesh-like electrode is disposed suitably spaced apart from the board.

In a preferred embodiment, in addition to the pair of electrodes disposed opposite to each other across the board, a mesh electrode is disposed above the toner entry side electrode with a suitable space provided therebetween and an alternating current is applied to the mesh electrode.

In a preferred embodiment, at least one of the paired electrodes disposed opposite to each other across the board is formed in a cylindrical shape fitted into the toner passage hole.

In a preferred embodiment, the board includes a pair of insulating boards stacked one on top of the other and the cylindrically shaped electrode is fitted into the toner passage hole in only one of the insulating boards.

In a preferred embodiment, the other of the pair of electrodes is a mesh-like electrode.

In the image forming apparatus of the present invention, the diameter a of each toner passage hole formed in the board is equal to or greater than one-fifth of the combined axial length b of the toner passage hole and its associated throughholes formed in the electrodes, the toner tending to clog the holes along said length, and what is more, ultrasonic vibrations are applied to the board. Therefore, there is no possibility that the toner will clog the throughholes of the electrodes and the toner passage hole.

Further, since the distance c between the base electrode and the toner exit side electrode of the toner control means is not greater than ten times the toner passage hole diameter, the toner passed through the toner passage hole is prevented from spreading in radial directions, thus assuring the formation of a toner image of restricted diameter on the recording paper placed on the base electrode.

When the insulating board in which the toner passage holes are formed is made from polyimide, a material that can provide sufficient dielectric strength and tensile strength even if the thickness is reduced, the thickness of the insulating board can be reduced down to 1 mm or less. Therefore, even when small-diameter toner passage holes are formed in the insulating board, there is no possibility that the holes will become clogged with toner.

Even if toner particles charged with a polarity opposite to the prescribed polarity are contained in the toner supplied to the toner control means, such toner particles are attracted onto the metal roller part of the sponge roller and are therefore prevented from passing through the toner passage hole when an image is not to be formed.

When the toner is made to pass through the toner passage holes, the time during which an electric field is formed within the toner passage hole can be made longer in order to increase the amount of toner passed through the toner passage hole, thereby adjusting the image density. It is also possible to adjust the amount of toner passed through the toner passage hole by adjusting the strength of the electric field formed in the toner passage hole. Thus, the density of the toner dot formed on the recording paper is changed to change the density of the image formed thereon.

The voltage applied to the base electrode is varied by the voltage adjusting means in order to adjust the speed at which the toner moves toward the base electrode. Also, by changing the voltage applied to the base electrode, the electric field formed by the base electrode and the toner entry side electrode provides electric lines of force of varying concentration. Since the toner moves along the electric lines of force, the voltage applied to the base electrode can be changed to control the degree of the radial dispersion of the toner passed through the toner passage holes, thereby adjusting the diameter of the dot formed on the recording paper.

Ultrasonic vibrations are applied to the board in which the toner passage holes are formed. When the strength of the ultrasonic vibrations is varied, the amount of toner to be passed through the toner passage hole changes, thus controlling the density of the resulting image.

The ultrasonic vibrations are propagated through the board, but since the elastic member works to absorb the vibrations, reflection of vibration waves does not occur. Since standing waves in which waves remain stationary interference with each other is thus avoided, the strength of the ultrasonic vibrations is distributed almost uniformly without concentrating on any particular point.

The heat generated from the ultrasonic vibration generating means is efficiently dissipated to the atmosphere by means of the vibrating member, thus achieving efficient cooling of the ultrasonic vibration generating means. Therefore, there is no possibility that the vibration characteristic will change or the vibration operation will stop.

By operating the ultrasonic vibration generating means when the image forming operation is not being performed, the toner deposited inside the toner passage holes can be separated from the toner passage holes. This serves to assure reliable removal of the toner from the toner passage holes.

Since the numerous toner passage holes are formed in the board in such a way as to partially overlap each other when viewed in the advancing direction of the recording paper, no breaks occur between the dots formed on the recording paper by the toner applied through adjacent toner passage holes.

BRIEF DESCRIPTION OF THE DRAWINGS

This invention may be better understood and its numerous objects and advantages will become apparent to those skilled in the art by reference to the accompanying drawings as follows:

FIG. 3 is a plan view of showing one part of a board, illustrating the arrangement of toner passage holes.

FIG. 5 is a plan view of the board, illustrating an example of arrangement of a common electrode and a signal electrode.

FIG. 9 is a cross sectional view showing the essential portions of still another mode of Example 2 of the present invention.

FIG. 10 is a cross sectional view showing the essential portions of an image forming apparatus according to Example 3 of the present invention.

FIG. 12*a* is a cross sectional view showing the essential portions of still another mode of Example 3 of the present invention, and FIG. 12*b* is a diagram illustrating the essential portions thereof.

FIG. 14*a* is a cross sectional view showing the essential portions of another mode of Example 4 of the present invention, and FIG. 14*b* is a diagram illustrating the essential portions thereof.

FIG. 19 is a cross sectional view showing the essential portions of another mode of Example 6 of the present invention.

FIG. 20 is a cross sectional view showing the essential portions of still another mode of Example 6.

FIG. 21 is a cross sectional view showing the essential portions of yet another mode of Example 6.

FIG. 22 is a cross sectional view showing the essential portions of a further mode of Example 6.

DESCRIPTION OF THE PREFERRED EMBODIMENTS

EXAMPLE 1

Figure 1:
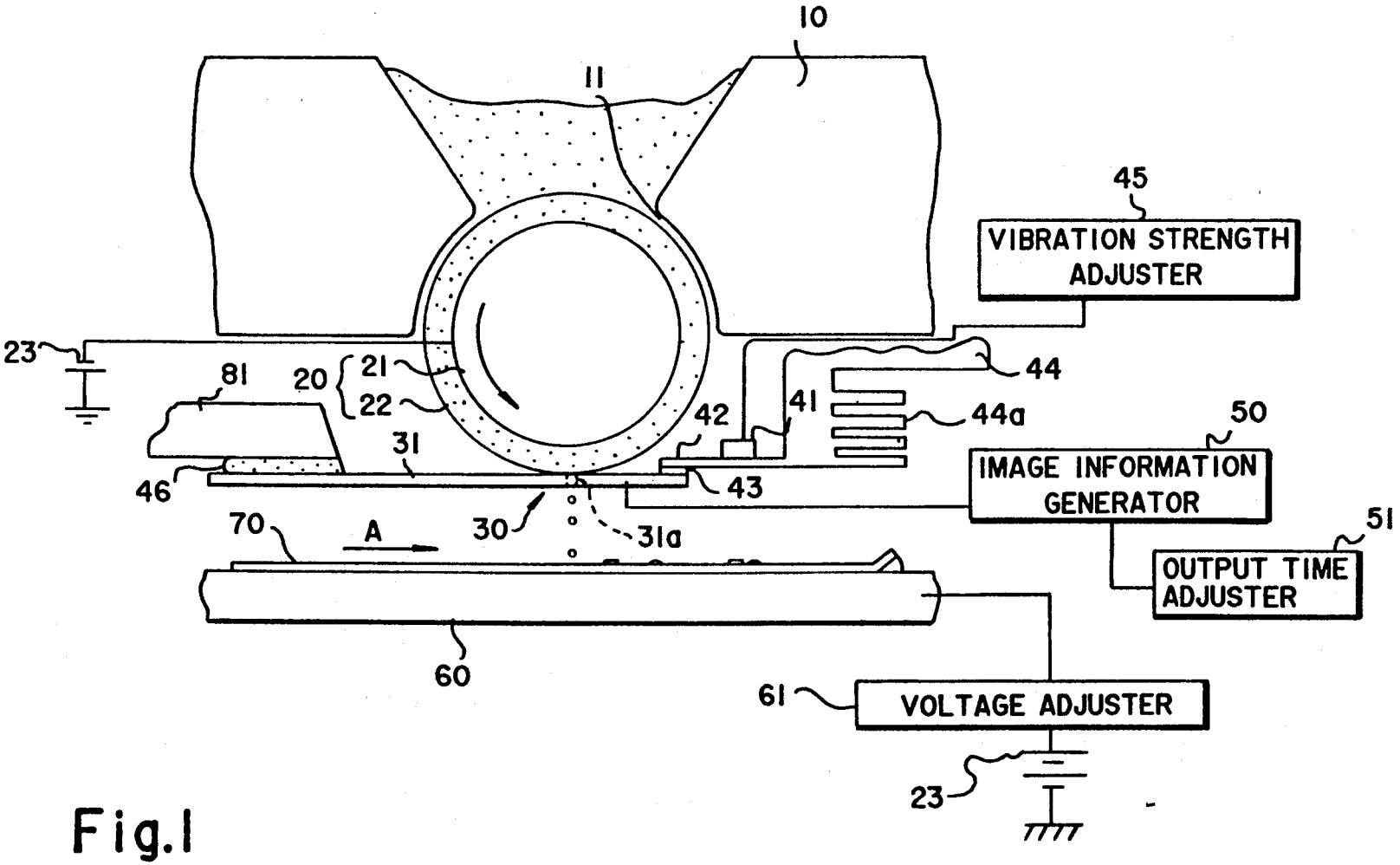
FIG. 1 is a schematic diagram showing an image forming apparatus according to Example 1 of the present invention.

As shown in FIG. 1, the image forming apparatus of the present invention includes a toner box 10 containing powdered toner, a toner feed roller 20 for continuously feeding toner downwardly from the toner box 10, and a toner control section 30 disposed below the toner feed roller 20.

Toner is supplied, as it is consumed, to the toner box 10 from a toner reservoir, such as a toner hopper, disposed thereabove. In the bottom of the space provided inside the toner box 10 for containing toner, there is formed an opening 11 into which the upper part of the toner feed roller 20 is accommodated. The toner feed roller 20 is a sponge roller, which consists of a conductive metal roller part 21 and an insulating elastic sponge layer 22 fitted around the outer circumferential surface of the metal roller part 21. The toner contained in the toner box 10 is negatively charged. Inside the metal roller part 21 of the toner feed roller 20, a power supply 23 is provided serving as a voltage applying means. The power supply 23 applies a negative voltage to the metal roller part 21 of the toner feed roller 20 so that the metal roller part 21 is charged with the same polarity as that of the negatively charged toner contained in the toner box 10. The toner contained in the toner box 10 is continuously fed downwardly by the rotation of the toner feed roller 20.

Below the toner feed roller 20 and adjacent thereto, an insulating board 31 is installed in a horizontal position forming a part of the toner control section 30 that controls the downward delivery of the toner. The insulating board 31 is formed, for example, from a glass fiber reinforced epoxy resin. The insulating board 31 may be installed in such a way as to be pressed against the sponge layer 22 of the toner feed roller 20. Numerous pinhole-like toner passage holes 31*a* (see FIG. 3) are formed in the insulating board 31, the toner passage holes 31*a* being arranged in a plurality of arrays extending along the axial direction of the toner feed roller 20. An electric field is formed within each toner passage hole 31*a* in response to an output signal from an image information generator 50, to control the passage of toner through the toner passage hole 31*a*. The image information generator 50 operates in response to signals supplied from a word processor, facsimile machine, computer or other apparatus, and generates electrical signals corresponding to image information.

Below the insulating board 31, a base electrode 60 is disposed in a horizontal position, and a recording paper 70 is placed on the base electrode 60. The recording paper 70 is transported in a direction (indicated by arrow A in FIG. 1) perpendicular to the direction in which the toner passage holes 31*a* are arrayed. The toner passed through the toner passage holes 31*a* in the insulating board 31 falls onto the recording paper 70 and adheres thereto. The toner passed through each individual passage hole 31*a* forms a dot on the recording paper 70, and an image is produced on the recording paper as a collection of such dots.

A bias voltage, suitably adjusted by an applied voltage adjuster 61, is applied to the base electrode 60. The dot diameter of the toner passed through each toner passage hole 31*a* is controlled by this bias voltage. As the bias voltage applied to the base electrode 60 is decreased, the force to converge the toner particles toward the axis of the toner passage hole 31*a* weakens, resulting in an enlarged dot diameter. Normally, the bias voltage applied to the base electrode 60 is controlled so that the dot diameter is restricted to not greater than 80%, preferably 60 to 70%, of the diameter of the toner passage hole 31*a*. The recording paper 70 with a toner image formed thereon is transported to a fusing unit (not shown) by which the toner image is fused to the recording paper 70.

A vibrating plate 42 is mounted on one side edge of the insulating board 31 of the toner control section 30, with a heat insulating member 43 interposed therebetween. On the vibrating plate 42, there is mounted an ultrasonic vibration generator 41 used to apply ultrasonic vibrations to the insulating board 31. The vibrating plate 42 is formed from a metallic material, such as aluminum, having good thermal conductivity and good ultrasonic vibration transmissibility. On the farther side edge of the vibrating plate 42 when viewed from the toner feed roller 20, a heat radiator 44 having radiating fins 44*a* is mounted in integral fashion with the vibrating plate 42.

The insulating board 31 is supported by a supporting member 81. The supporting member 81 supports the insulating board 31, via an elastic member 46 formed from rubber or the like, at the side edge thereof opposite to the side edge where the ultrasonic vibration generator 41 is mounted.

A vibration strength adjuster 45 is connected to the ultrasonic vibration generator 41 to adjust the strength of the ultrasonic vibrations to be generated. The vibration strength adjuster 45 is operated when adjusting the density of the image to be formed. The amplitude of the ultrasonic vibration generated by the ultrasonic vibration generator 41 is varied by varying, for example, the voltage applied to the ultrasonic vibration generator 41. The vibration strength adjuster 45 may also be so configured as to vary the strength of the ultrasonic vibrations by varying the frequency of the alternating current used to drive the ultrasonic vibration generator 41.

The ultrasonic vibration generator 41 should preferably generate sinusoidal waves, square waves, chopping waves, etc. with the resonant frequency in the range of 20 KHz to 1 MHz, and a piezoelectric element, such as PZT or the like, is suitably used for the purpose. The ultrasonic vibrations generated by the ultrasonic vibration generator 41 are transferred to the insulating board 31 via the vibrating plate 44, thereby breaking up the toner fed to the insulating board 31 into particles while giving kinetic energy to the toner particles.

The numerous pinhole-like toner passage holes 31*a* formed in the insulating board 31 each have an equal diameter, as shown in FIG. 3, and are arranged in a plurality of arrays extending, for example, in the direction perpendicular to the advancing direction, indicated by the arrow A, of the recording paper 70. The toner passage holes 31*a* in each array are equally spaced apart from each other. The toner passage holes 31*a* also form arrays extending diagonally relative to the recording paper 70 advancing direction (direction A), and the adjacent toner passage holes 31*a* arrayed in the direction diagonal to direction A overlap each other by a prescribed dimension d ($\geqq 0$) in the direction perpendicular to the advancing direction of the recording paper 70. The dimension d is smaller than the diameter of each toner passage hole 31*a*.

Instead of arranging the toner passage holes in a plurality of arrays extending in the direction perpendicular to the advancing direction of the recording paper 70, the toner passage holes may be formed in a single array extending diagonally relative to the direction perpendicular to the advancing direction of the recording paper 70 in such a manner that the adjacent toner passage holes 31*a* overlap each other in the advancing direction of the recording paper 70.

Figure 2:
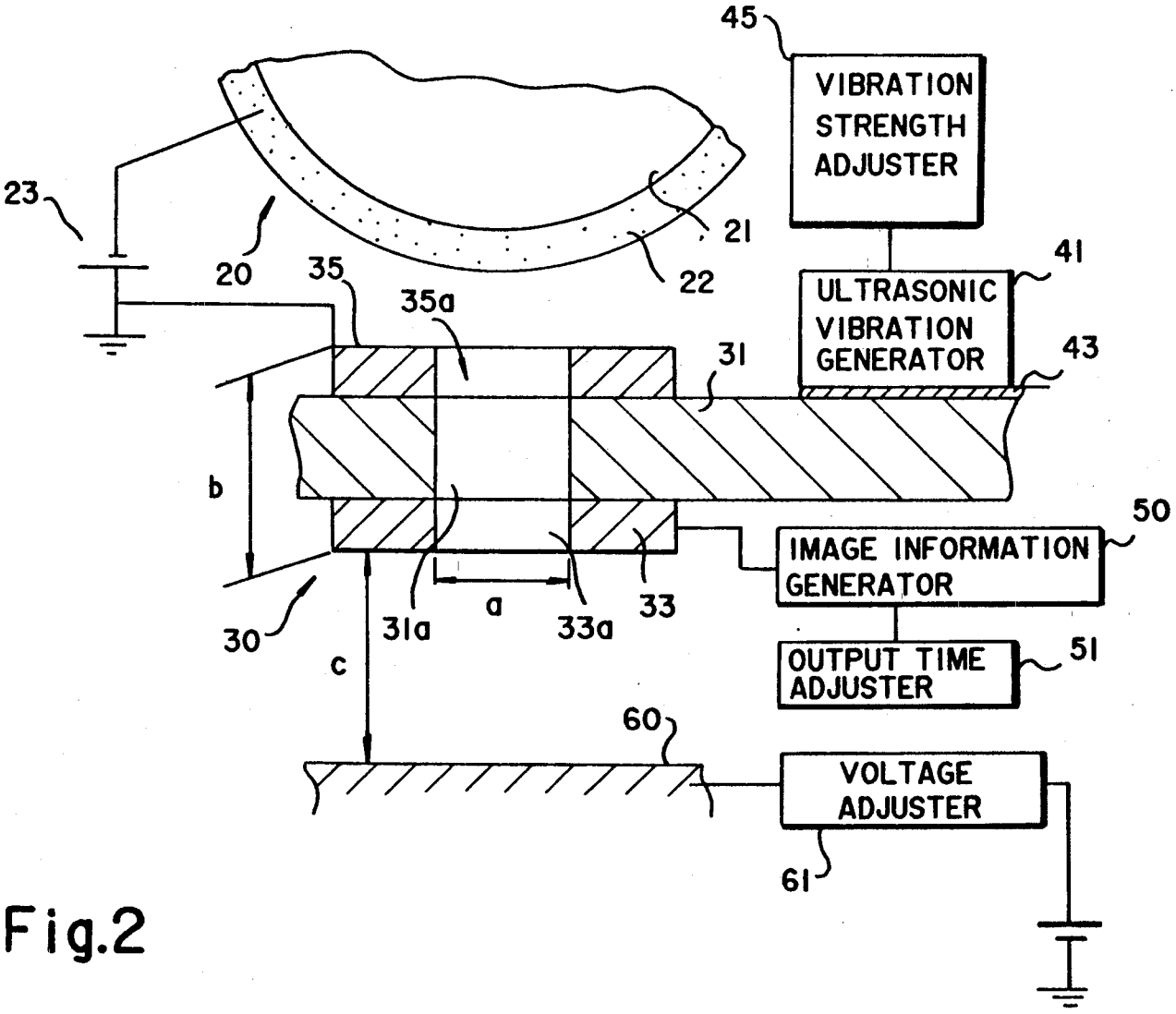
FIG. 2 is an enlarged view the essential portions thereof.

As shown in FIG. 2, a planar common electrode 35 is mounted on the upper surface of the insulating board 31. The common electrode 35 is provided with a plurality of throughholes 35*a* each having a diameter identical to that of the pinhole-like toner passage holes 31*a* and is mounted on the upper surface of the insulating board 31 in such a manner that the throughholes 35*a* are aligned with the respective toner passage holes 31*a* in the insulating board 31. On the underside of the insulating board 31, there are mounted a large number of small signal electrodes 33 one for each individual toner passage hole 31*a*. Each signal electrode 33 is also provided with a throughhole 33*a* having a diameter identical to that of the toner passage holes 31*a* in the insulating board 31 and is mounted on the insulating board 31 in such a manner that the throughhole 33*a* is aligned with the corresponding toner passage hole 31*a* in the insulating board 31.

The common electrode 35 mounted on the insulating board 31 is grounded, while the signal electrodes 33 mounted on the other side of the insulating board 31 are connected to the image information generator 50 so that an electrical signal of a prescribed voltage is applied from the image information generator 50 to each signal electrode 33 in response to image information. A positive or a negative voltage is applied from the image information generator 50 to each signal electrode 33 in accordance with the image information. For example, a pulse voltage of +100 V is applied for information requiring image formation, and −100 V for information not requiring image formation.

The image information generator 50 is provided with an output time adjuster 51 for varying the output time of the image signal. The output time adjuster 51 is operated, for example, in such a manner as to extend the output time of the image signal when increasing the density of the image to be formed, and to shorten the output time of the image signal when lowering the density of the image to be formed.

The throughholes 33*a* and 35*a* formed in the signal electrodes 33 and the common electrode 35, respectively, each have a diameter a identical to that of the toner passage holes 31*a* formed in the insulating board 31, and the distance b between the upper end face of the common electrode 35 from which the toner enters and the lower end face of the signal electrode 33 from which the toner exits should not be greater than five times the diameter a ($5a \geqq b$), and preferably not greater than the diameter a ($a \geqq b$). The toner passage holes 31*a* should usually be 0.1 to 1.0 mm in diameter.

Also, the distance c between the lower end face of each signal electrode 33 and the base electrode 60 should not be greater than ten times the diameter a of the throughhole 33*a* in the signal electrode 33 ($10a \geqq c$), the distance c being 2.5 mm at maximum.

In the case of the insulating board 31 formed from a glass fiber reinforced epoxy resin, the toner passage holes 31*a*, the common electrode 35, and the signal electrodes 33 are formed in the following manner. A copper sheet is attached on both sides of the insulating board 31, and holes are opened through the insulating board 31 and the copper sheets, thereby forming toner passage holes 31*a* in the insulating board 31, throughholes 35*a* in the common electrode 35, and throughholes 33*a* in each signal electrode 33. Subsequently, a required pattern is printed on the copper sheets, and unnecessary portions are removed by etching, to form a large number of separate signal electrodes 33 insulated from each other and each corresponding to each individual toner passage hole 31*a*. The insulating board 31 is thus fabricated, on which the common electrode 35 and the numerous signal electrodes 33 are provided and in which the numerous toner passage holes 31*a* are formed.

A toner image forming process performed in the image forming apparatus of the above construction will be described below.

When the toner feed roller 20 is rotated, the negatively charged toner contained in the toner box 10 falls onto the common electrode 35 of the toner control section 30. Since ultrasonic vibrations of a constant amplitude are being applied to the common electrode 35 via the insulating board 31 of glass fiber reinforced epoxy resin by means of the ultrasonic vibration generator 41 mounted on the insulating board 31, lumps of toner falling on the common electrode 35 are suitably broken up, the thus broken up toner falling into the toner passage holes 31*a* in the insulating board 31 through the throughholes 35*a* in the common electrodes 35. Since the metal roller part 21 of the toner feed roller 20 is negatively charged by the power supply 23, a voltage applying means, the negatively charged toner is repelled by the metal roller part 21 which is also negatively charged, thus assuring reliable application of the toner to the common electrode 35.

At this time, if any toner charged positively, i.e. reverse polarity from the negative charge, is contained in the toner box 10, the positively charged toner is attracted to the negatively charged metal roller part 21, thus preventing such toner from being distributed onto the common electrode 35.

Since the insulating board 31 is formed from a rigid glass fiber reinforced epoxy resin having good ultrasonic vibration transmissibility, the ultrasonic vibrations are effectively transferred to the common electrode 35. As a result, the toner lumps on the common electrode 35 are effectively broken up. Also, the ultrasonic vibration generator 41 is adapted to transfer ultrasonic vibrations to the common electrode 35 via the insulating board 31 without increasing its driving voltage, which serves to suppress the heating of the ultrasonic vibration generator 41.

Furthermore, since the ultrasonic vibration generator 41 is supported on the vibrating plate 42 having good thermal conductivity, the heat generated by the ultrasonic vibration generator 41 is effectively transferred to the heat radiator 44 through the vibrating plate 42 and is dissipated from the radiating fins 44*a* to the atmosphere. Thus, the heat generated as a result of applying an AC voltage to the ultrasonic vibration generator 41 for a long time is effectively released to the atmosphere, which prevents the vibration characteristic of the ultrasonic vibration generator 41 from varying or the vibrating operation of the ultrasonic vibration generator 41 from stopping. The radiating fins 44*a* provided on the heat radiator 44 serve to increase the heat dissipation, thus assuring improved cooling of the ultrasonic vibration generator 41.

Also, because of the presence of the heat insulating member 43 between the insulating board 31 of glass fiber reinforced epoxy resin and the vibrating plate 42, the heat generated by the ultrasonic vibration generator 41 is prevented from being transferred to the insulating board 31. Therefore, even when the insulating board 31 is formed from a material, such as a glass fiber reinforced epoxy resin, having high ultrasonic vibration transmissibility but low heat resistance, there is no concern of thermal degradation.

Furthermore, since the elastic member 46 is provided via which the side edge of the insulating board 31 opposite to the side edge thereof where the ultrasonic vibration generator 41 is mounted is supported by the supporting member 81, the ultrasonic vibrations generated by the ultrasonic vibration generator 41 and propagated through the insulating board 31 are absorbed by the elastic member 46. This prevents generation of reflected waves interfering with the ultrasonic vibrations generated by the ultrasonic vibration generator 41 and causing standing waves. As a result, the ultrasonic vibrations are not concentrated on any particular point but uniformly distributed throughout the insulating board 31, thus equalizing the amount of toner falling through the insulating board 31.

The toner particles falling into each individual toner passage hole 31*a* in the insulating board 31 are controlled in accordance with the image signal applied to the corresponding signal electrode 33 so that they are allowed to fall onto the recording paper 70 or are fed back onto the common electrode 35. When a positive voltage of +100 V is applied by the image information generator 50 to the signal electrode 33 in order to form an image, an electric field directed from the signal electrode 33 toward the counter electrode 35 is created within the toner passage hole 31*a*. Because of this electric field, the negatively charged toner particles are attracted toward the signal electrode 33 and are passed through the signal electrode 33 to fall onto the recording paper 70 placed on the base electrode 60. The base electrode 60 is supplied with a positive bias voltage with respect to the common electrode 35, ensuring the toner particles passed through the toner passage hole 31*a* fall onto the recording paper 70. The bias voltage applied to the base electrode 60 is sufficiently greater than the electrical signal applied to the signal electrode 33, and is controlled by the applied voltage adjuster 61 to a suitable value within the range of 300 to 1000 V in the case of the negatively charged toner. If the bias voltage is lower than 300 V, the force to converge the toner particles toward the axis of the toner passage hole 31*a* is reduced, resulting in the formation of an enlarged dot on the recording paper 70, which may interfere with proper image formation on the recording paper 70. Conversely, if the bias voltage is higher than 1000 V, discharge may result.

On the other hand, when a negative voltage of −100 V is applied by the image information generator 50 to the signal electrode 33 in order not to form an image, an electric field directed from the upper side common electrode 35 toward the lower side signal electrode 33 is formed within the toner passage hole 31*a*, exerting a force to move the negatively charged toner back to the common electrode 35.

As previously noted, there is a relationship of $5a \geqq b$ between the diameter a and the combined axial length b of the toner passage hole 31*a* and the throughholes 33*a*, 35*a* in the signal electrode 33 and the common electrode 35, the toner passing along said length. This means that the holes through which the toner passes have a combined axial length smaller than their diameter a. Besides, ultrasonic vibrations are applied to the insulating board 31, signal electrode 33, and common electrode 35. As a result, there is almost no possibility that the toner particles will clog the throughholes 33*a*, 35*a* and the toner passage hole 31*a* while passing therethrough. Furthermore, under these circumstances, no adverse effects are caused to the speed at which the toner particles pass through the holes, and therefore, the toner particles fall on the recording paper 70 with sufficient accuracy.

Also, since the distance c between the lower end face of the signal electrode 33, from which the toner exits, and the upper end face of the base electrode 60 is not greater than ten times the diameter a of the throughhole 33*a* in the signal electrode 33, the toner particles passed through the throughhole 33*a* in the signal electrode 33 are prevented from spreading in radial directions, so that the toner particles, converged toward the axis of the throughhole 33*a* in the signal electrode 33, are deposited onto the recording paper 70 placed on the base electrode 60. Since the toner particles can thus be made to fall while maintaining the restricted diameter, it is possible to precisely control the position onto which the toner particles fall even when the electric field strength between the base electrode 60 and the common electrode 35 is decreased by reducing the voltage applied to the base electrode 60. Further, since the distance c is short, as described, the time required for the toner particles to reach the recording paper 70 is shortened, thus achieving a high speed formation of an image.

As previously mentioned, the diameter of the dot formed on the recording paper 70 is controlled to 80% or less of the diameter of the toner passage hole 31*a*, and further, the toner passage holes 31*a* arrayed in the advancing direction of the recording paper 70 overlap each other by a distance d in the direction perpendicular to the advancing direction of the recording paper 70. Therefore, when, for example, four dots are formed on the recording paper 70 by the toner passed through four toner passage holes 31*a* disposed adjacent each other in a square shape, the resulting image is a square with at least diagonally adjacent dots overlapping each other.

In order to adjust the quality of the image to be formed on the recording paper 70, the bias voltage applied to the base electrode 60 is adjusted using the applied voltage adjuster 61. For example, the bias voltage applied to the base electrode 60 is increased to render sharper edges to the image produced. An electric field is formed between the base electrode 60 and the signal electrode 33 in proportion to the bias voltage applied to the base electrode 60, and the toner falling through the toner passage hole 31*a* in the insulating board 31 moves along the lines of force of the electric field. Therefore, as the electric field strength increases, a greater toner attraction force is exerted by the base electrode 60, while suppressing radial dispersion of the electric lines of force. Accordingly, the toner falling along the electric lines of force falls at high speed while maintaining its shape converged toward the axis of the toner passage hole 31*a* and without spreading in radial directions. This results in the formation of a small diameter dot on the recording paper 70, serving to render sharp edges to the resulting image.

On the other hand, to form an image with gradations, the bias voltage applied to the base electrode 60 is decreased using the applied voltage adjuster 61. As a result, the strength of the electric field formed between the signal electrode 33 and the base electrode 60 decreases, and the toner passed through the toner passage hole 31*a* falls at a slower speed along the electric lines of force spreading in radial directions. This results in the formation of a slightly larger diameter dot on the recording paper 70, achieving image formation with good gradations.

To adjust the density of the image to be formed, the output time adjuster 51 connected to the image information generator 50 is operated. For example, to increase the density of the image to be formed, the output time adjuster 51 is operated in such a manner as to extend the time during which a pulse voltage of +100 V is applied as an image forming signal from the image information generator 50 to the signal electrode 33, thereby increasing the amount of toner passing through the toner passage hole 31*a*. As a result, the dot is formed on the recording paper 70 in high density and with an increased diameter by the toner thus passed through the toner passage hole 31*a*, thus achieving the formation of an image with high density. On the other hand, to lower the density of the image to be formed, the output time adjuster 51 is operated in such a manner as to shorten the time during which the pulse voltage of +100 V is applied as an image forming signal from the image information generator 50 to the signal electrode 33, thereby decreasing the amount of toner passing through the toner passage hole 31*a*. As a result, the dot is formed on the recording paper 70 in low density and with a decreased diameter by the toner thus passed through the toner passage hole 31*a*, thus achieving the formation of an image with low density.

Figure 4:
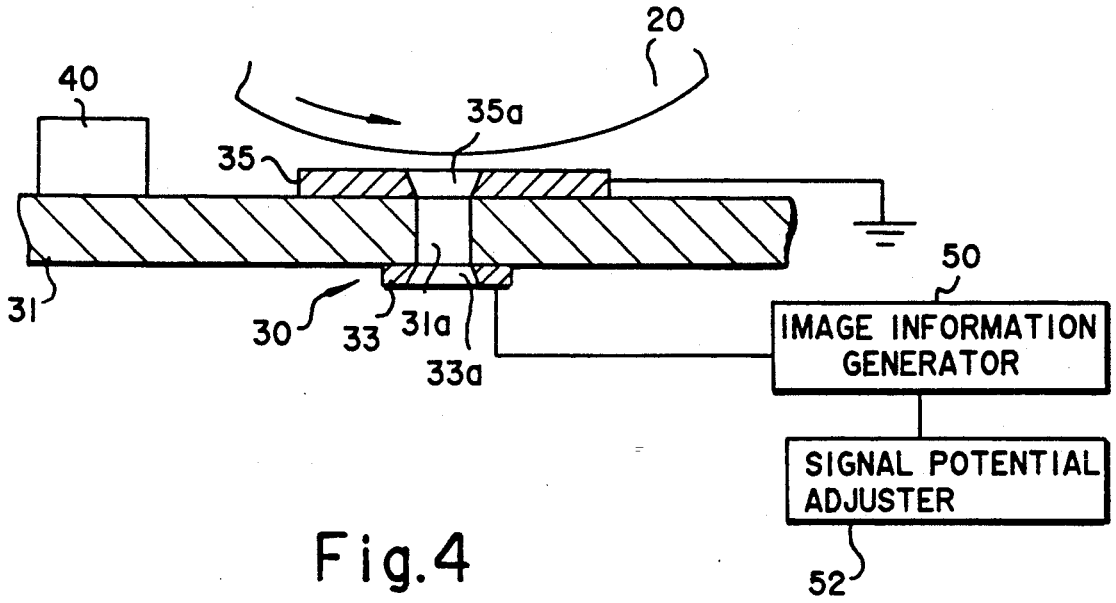
FIG. 4 is a schematic diagram of a toner control section in which a signal potential adjuster is provided instead of an output time adjuster for an image information generator.

Instead of the output time adjuster 51 for adjusting the image density, a signal potential adjuster 52 for adjusting the value of the voltage supplied as an image forming signal may be connected to the image information generator 50, as shown in FIG. 4. Using the signal potential adjuster 52, the value of the pulse voltage applied as an image forming signal from the image information generator 50 to the signal electrode 33 is adjusted with reference to +100 V according to the desired density of the image to be formed. For example, to increase the density of the image to be formed, the signal potential adjuster 52 is operated in such a manner as to raise the value of the pulse voltage, applied as an image forming signal from the image information generator 50 to the signal electrode 33, higher than +100 V, thereby increasing the strength of the electric field formed in the toner passage hole 31*a*. This serves to increase the amount of toner passing through the toner passage hole 31*a*, forming the dot on the recording paper 70 in high density and with an increased diameter. As a result, an image with high density is formed on the recording paper 70. On the other hand, to lower the density of the image to be formed, the signal potential adjuster 52 is operated in such a manner as to decrease the value of the pulse voltage, applied as an image forming signal from the image information generator 50 to the signal electrode 33, lower than +100 V, thereby reducing the strength of the electric field formed in the toner passage hole 31*a*. This serves to reduce the amount of toner passing through the toner passage hole 31*a*, forming the dot on the recording paper 70 in low density and with a decreased diameter. As a result, an image with low density is formed on the recording paper 70.

In forming an image, when there arises a need, for example, to make adjustments against variations in the image density due to changes in surrounding conditions such as ambient temperature, humidity, etc. or to fine-adjust the density of the image to be formed, such adjustments are accomplished by operating the vibration strength adjuster 45 which is provided for the ultrasonic vibration generator 41.

To increase the image density, the vibration strength adjuster 45 is operated in such a manner as to increase the strength of the ultrasonic vibrations to be generated by the ultrasonic vibration generator 41. As a result, stronger vibrations are applied to the insulating board 31 of the toner control section 30, thereby increasing the amount of toner passing through the toner passage hole 31*a* in which an electric field is formed exerting force in the toner passing direction. This serves to increase the density, as well as the diameter, of the dot formed on the recording paper 70 by the toner passed through the toner passage hole 31*a*, thus achieving the formation of an image with high density on the recording paper 70. On the other hand, to lower the image density, the vibration strength adjuster 45 is operated in such a manner as to decrease the strength of the ultrasonic vibrations to be generated by the ultrasonic vibration generator 41. As a result, vibrations of relatively weak strength are applied to the insulating board 31 of the toner control section 30, thereby reducing the amount of toner passing through the toner passage hole 31*a* in which an electric field is formed exerting force in the toner passing direction. This serves to decrease the density, as well as the diameter, of the dot formed on the recording paper 70 by the toner passed through the toner passage hole 31*a*, thus achieving the formation of an image with low density on the recording paper 70.

In the case of the toner passage holes 31*a* arranged, as shown in FIG. 5, in a plurality of arrays extending in the direction perpendicular to the advancing direction of the recording paper 70, it may be so configured that one common electrode 35' is provided for each array of toner passage holes 31*a* arranged in the direction perpendicular to the advancing direction of the recording paper 70 while one signal electrode 33' is provided for each array of toner passage holes 31*a* arranged diagonally relative to the advancing direction of the recording paper 70. In such configuration, a voltage of 300 V is normally applied to each common electrode 35', which is periodically set to 0 V with a duty ratio of 1/n. For example, when four strips of common electrodes 35' are provided, the duty ratio with which each common electrode 35' is periodically set to 0 V is set at ¼ (25%); the duty ratio is 1/5 (20%) when five common electrodes 35' are provided, and 1/10 (10%) when ten common electrodes 35' are provided. With such duty ratios, any one of the common electrodes 35' is set at 0 V at any point of time, and synchronizing with the timing at which each common electrode 35' is set to 0 V, a voltage of 100 V is applied as an image forming signal to the signal electrode 33' corresponding to the toner passage hole 31*a* which is associated with the common electrode 35' that has been set to 0 V and through which the toner is to be passed. With such configuration, the number of driver elements such as ICs and transistors to be provided for the signal electrodes can be drastically reduced as compared with the configuration in which each toner individual passage hole 31*a* is provided with a separate signal electrode.

The pitch P2 between the toner passage hole arrays extending in the direction perpendicular to the advancing direction of the recording paper 70 should preferably have the following relationship with the pitch P1 between the toner passage holes 31*a* arrayed diagonally relative to the advancing direction of the recording paper, the pitch P1 being measured in the direction perpendicular to the advancing direction of the recording paper.

$$P1 \times (m + e/n) = P2$$

where m is an integer, and e is a number the least multiple of which by n is e×n.

Figure 6:
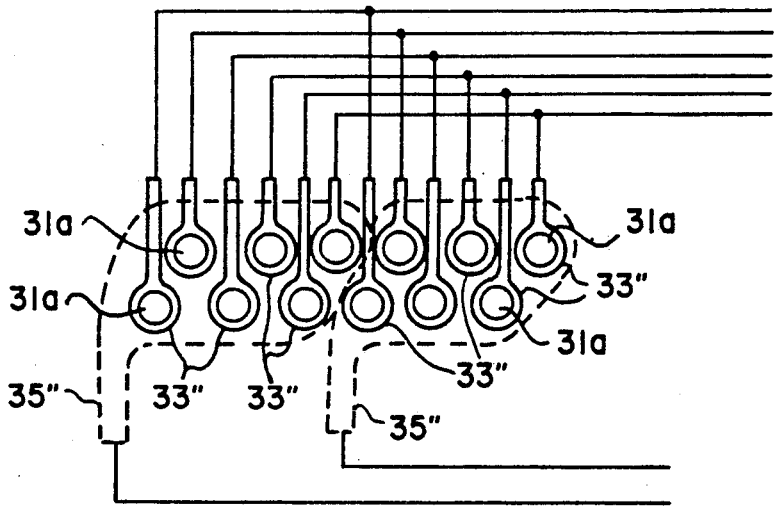
FIG. 6 is a plan view of the board, illustrating another example of an arrangement of the common electrode and the signal electrode.

Also, it may be so configured, for example, as shown in FIG. 6, that one common electrode 35″ is provided for every group of six adjacent toner passage holes 31*a*, while corresponding signal electrodes 33″ between different common electrodes 35″ are connected to each other so as to achieve simultaneous control of the corresponding signal electrodes 33″ for the corresponding toner passage holes 31*a* between the different common electrodes 35″.

Since the toner passage holes 31*a* are as tiny as pinholes, there is a possibility that the toner may adhere to the inner walls thereof, eventually clogging the toner passage holes 31*a* with the toner. To prevent this, a cleaning operation is performed to clean the toner passage holes 31*a* during an image formation off period, for example, during a prescribed period before the apparatus gets ready for an image forming operation after the main switch has been turned on or during a prescribed period after the main switch has been turned off. The cleaning operation is performed by driving the ultrasonic vibration generator 41 with the vibration strength adjuster 45 adjusted so that the strength of the ultrasonic vibrations applied from the ultrasonic vibration generator 41 to the insulating board 31 of the toner control section 30 is greater than that of the ultrasonic vibrations applied during a normal image forming operation. Since the insulating board 31 is thus subjected to the ultrasonic vibrations generated by the ultrasonic vibration generator 41 with an increased strength, the toner adhering to the inner walls of the toner passage holes 31*a* become separated therefrom. In this situation, a negative voltage, which is the same one as the image non-forming signal, is applied to the signal electrodes 33 by the image information generator 50. This causes the toner separated from the toner passage holes 31*a* to be fed back to the toner feed roller 20, thus accomplishing the removal from the toner passage holes 31*a* of the toner adhering thereto.

The insulating board 31 may be formed from a rigid, photosensitive polymeric material that can provide good propagation of ultrasonic vibrations. The insulating board 31 formed from a photosensitive polymer is capable of effectively transferring the ultrasonic vibrations generated by the ultrasonic vibration generator 41 to the common electrode 35. In the case of such an insulating board 31 being formed from a photosensitive polymer, a pattern of toner passage holes 31*a* can be drawn directly on the insulating board 31, and by etching the pattern using ultraviolet radiation, the toner passage holes 31*a* with a small diameter can be formed with high accuracy and efficiency.

The insulating board 31 may also be formed from a polyimide film. A polyimide insulating board 31 having numerous toner passage holes formed therein can be formed with a thickness of 1 mm or less. Since the polyimide provides a dielectric breakdown voltage not less than 50 kV/mm and a tensile strength not less than 1 kg/mm$^2$, the thickness can be reduced to 1 mm or less without concern of breakdown by the voltage applied through the signal electrodes 33 or the common electrode 35 and without concern of breakage when the insulating board 31 is subjected to the ultrasonic vibrations applied from the ultrasonic vibration generator 41. Furthermore, there is no possibility of breaking the insulating board 31 when numerous toner passage holes 31*a* each provided with an electrode are formed therein.

Since the insulating board 31 formed from a polyimide film is 1 mm or less in thickness, the toner passage holes 31*a* formed across the thickness of the insulating board 31 are prevented from becoming clogged with toner particles. Because of the strength of the polyimide insulating board 31 as mentioned above, it is possible to increase the frequency of the pulse voltage applied to the signal electrodes 33. Furthermore, with a polyimide insulating board 31, it is easy to form the signal electrodes 33 and the common electrode 35 in a printed wiring pattern.

In the present invention, it is desirable to use toner having a relatively small average particle size of 5 to 20 μm. A toner having such small particle size permits the formation of images with good resolution.

It is also desirable to set the diameter of each toner passage hole 31*a* to about 50 to 300 μm. On the other hand, the distance between the toner control section 30 and the recording paper 70 should normally be within the range of 0.3 to 2.5 mm although it depends on the magnitude of the applied voltage fed from the image information generator 50.

The sponge roller is suitable for use as the toner feed roller 20 since it effectively breaks up solid masses of toner in the toner box 10 by the rotation thereof. Also, since the toner is held almost uniformly in the sponge layer 22 on the surface of the sponge roller, a constant amount of toner is always distributed to the toner control section 30.

Although it depends on the kind of roller, the frequency of vibration generated by the ultrasonic vibration generator 41, and other factors, the surface speed of the toner feed roller 20 should preferably be 50 mm/second or faster. If the surface speed of the toner feed roller 20 is slower than 50 mm/second, the resulting toner image may lack density.

EXAMPLE 2

Figure 7:
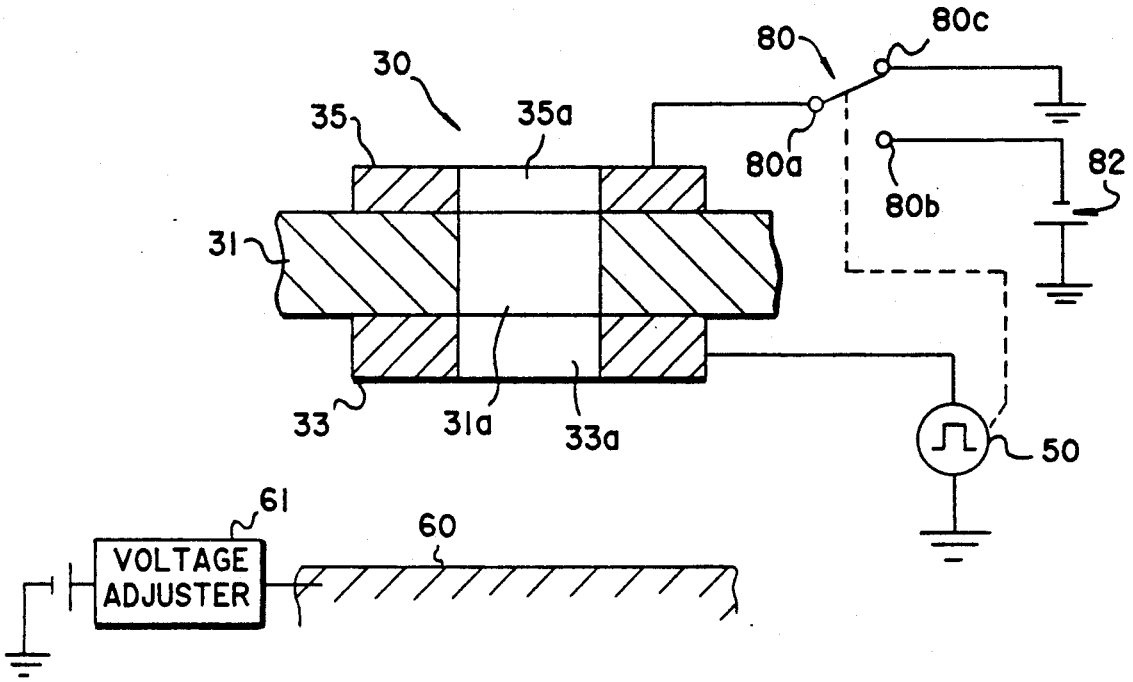
FIG. 7 is a cross sectional view showing the essential portions of an image forming apparatus according to Example 2 of the present invention.

FIG. 7 shows an example of an image forming apparatus capable of forming high-density images without fogging.

The common electrode 35 on the insulating board 31 is connected to a common terminal 80*a* of a selector switch 80. One terminal 80*b* on the switching side of the selector switch 80 is connected to a power supply 82 that supplies a voltage of −100 V, for example. The other terminal 80*c* on the switching side is grounded. The selector switch 80 is switched between the two terminals in accordance with the signal supplied from the image information generator 50. When a pulse voltage of +100 V is supplied from the image information generator 50 in order to form an image, the selector switch 80 is switched to connect the common terminal 80*a* to the switching side terminal 80*b* connected to the power supply 82, so that a voltage of −100 V is applied to the common electrode 35. As a result, an electric field of high strength directed from the signal electrode 33 toward the common electrode 35 is formed, which causes negatively charged toner particles to be attracted to the signal electrode 33, pass through the signal electrode 33, and fall onto the recording paper 70 placed on the base electrode 60. Since the electric field thus formed between the common electrode 35 and the signal electrode 33 has a greater strength than that of the foregoing Example 1, a larger amount of toner passes through the toner passage hole 31*a* at a faster speed, thereby accomplishing the formation of an image with higher density.

On the other hand, when a pulse voltage of −100 V is supplied from the image information generator 50 in order not to form an image, the selector switch 80 is switched to connect the common terminal 80*a* to the grounded switching side terminal 80*c*, thus setting the common electrode 35 to 0 V. This prevents the negatively charged toner from being fed into the toner passage hole 31*a*. Therefore, when a signal not to form an image is issued from the image information generator 50, there is no possibility of the toner passing through the toner passage hole 31*a*, thus preventing fogging of the image produced on the recording paper 70.

Figure 8:
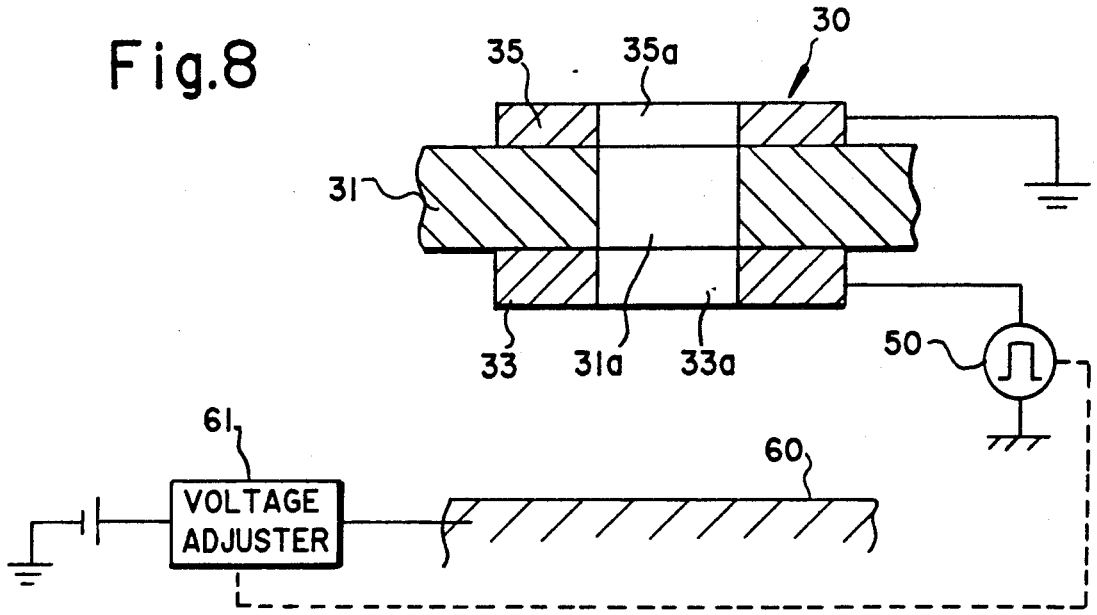
FIG. 8 is a cross sectional view showing the essential portions of another mode of Example 2 of the present invention.

In the image forming apparatus shown in FIG. 8, the voltage adjuster 61 for adjusting the bias voltage applied to the base electrode 60 is operated in accordance with the image signal supplied from the image information generator 50. The common electrode 35 is grounded. The voltage adjuster 61 operates in such a manner that when a pulse voltage of +100 V is applied from the image information generator 50 to the signal electrode 33 in order to form an image, a prescribed voltage having positive polarity with respect to the grounded common electrode 35 is applied to the base electrode 60. On the other hand, when a pulse voltage of −100 V is applied to the signal electrode 33 from the image information generator 50 in order not to form an image, the voltage adjuster 61 operates in such a manner that no voltage or a voltage significantly lower than the above voltage applied to the base electrode 60 for image formation is applied to the base electrode 60. The voltage adjuster 61 may also be so configured that a voltage of opposite polarity to that of the voltage applied to the base electrode 60 for image formation is applied when a signal not to form an image is issued from the image information generator 50.

When forming an image on the image forming apparatus shown in FIG. 8, the negatively charged toner passed through the toner passage hole 31*a* is attracted by the base electrode 60 to which a bias voltage higher than that applied to the common electrode 35 is applied by means of the voltage adjuster 61. As a result, the toner passed through the toner passage hole 31*a* is deposited on the recording paper 70 without spreading in radial directions but with its diameter restricted. This serves to enhance the quality of the produced image. On the other hand, when not forming an image, since the base electrode 60 is set at a low potential with respect to the grounded common electrode 35 by means of the voltage adjuster 61 or is so set, together with the common electrode 35, as to form an electric field to move the toner upward, the toner is prevented from falling toward the base electrode 60, thus preventing the fogging of the image produced.

In the image forming apparatus shown in FIG. 9, a toner feed voltage adjuster 90 is provided between the metal roller part 21 of the toner feed roller 20 and the common electrode 35. The toner feed voltage adjuster 90 includes a selector switch 91 the common terminal 91*a* of which is connected to the metal roller part 21. One terminal 91*b* on the switching side of the selector switch 91 is grounded, while the other terminal 91*c* on the switching side is connected to a power supply 92 the positive terminal of which is grounded. The power supply 92 therefore supplies a negative voltage.

The selector switch 91 is controlled based on the image information supplied from the image information generator 50.

When a pulse voltage of +100 V is issued from the image information generator 50 in order to form an image, the selector switch 91 is switched to connect the common terminal 91*a* to the switching side terminal 91*c* connected to the power source 92, so that a negative voltage is applied to the metal roller part 21 of the toner feed roller 20. As a result, the negatively charged toner is repelled by the metal roller part 21 to which the negative voltage is applied, and is reliably fed onto the insulating board 31. Since the pulse voltage of +100 V issued from the image information generator 50 is applied to the signal electrode 33, an electric field directed from the signal electrode 33 toward the common electrode 35 is formed within the toner passage hole 31*a*, causing the toner fed from the toner feed roller 20 to pass through the toner passage hole 31*a*. The toner thus passed through the toner passage hole 31*a* falls onto the recording paper 70 by being attracted by the base electrode 60 to which the bias voltage is applied.

On the other hand, when a pulse voltage of −100 V is supplied from the image information generator 50 to the signal electrode 33 in order not to form an image, the selector switch 91 is switched to connect the common terminal 91*a* to the grounded switching side terminal 91*b*, so that the potential at the metal roller part 21 of the toner feed roller 20 is set to 0 V. As a result, the negatively charged toner is attracted to the grounded metal roller part 21, preventing the negatively charged toner from separating from the toner feed roller 20. Therefore, there is no possibility of the toner passing through the toner passage hole 31*a*, thus preventing the fogging of the image produced on the recording paper 70.

EXAMPLE 3

In the image forming apparatus shown in FIG. 10, there is provided, below the signal electrode 33 and above the base electrode 60, a toner deflecting device 73 for deflecting the toner passed through the toner passage hole 31*a* along the axial direction of the tone feed roller 20 (along the direction perpendicular to the transporting direction of the recording paper). The toner deflecting device 73 includes: a pair of deflection plates 71 disposed opposite each other suitably spaced apart along the direction perpendicular to the transporting direction of the recording paper; and a feeder 72 for applying between the paired deflection plates 71 a pulse voltage whose polarity is alternately reversed.

In the thus constructed toner deflecting device 73, the feeder 72 applies a pulse voltage between the two deflection plates 71, the polarity of the pulse voltage alternating between positive and negative and in accordance with which the toner passed through the toner passage hole 31*a* is defected toward either one of the deflection plates 71 along the direction perpendicular to the advancing direction of the recording paper. This permits unbroken formation of dots formed by the toner passed through the toner passage holes 31*a* even when the plurality of toner passage holes 31*a* formed along the axial direction of the toner feed roller 20 are further spaced apart from each other. As a result, a significant improvement of the image resolution can be achieved even if the numerous toner passage holes 31*a* are not formed with a close pitch.

Figure 11:
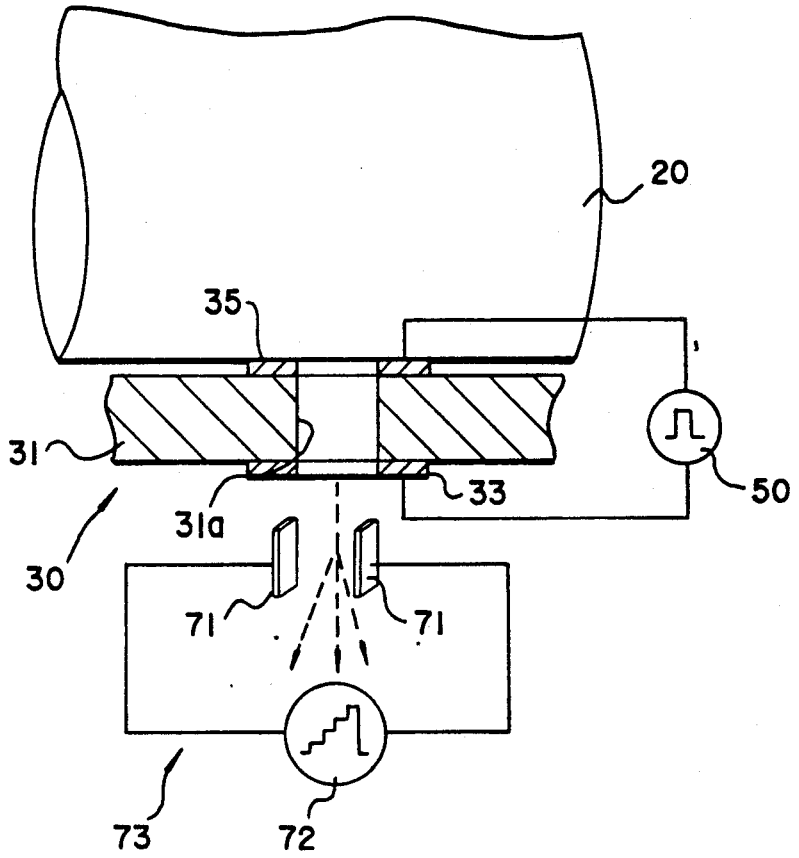
FIG. 11 is a cross sectional view showing the essential portions of another mode of Example 3 of the present invention.

The toner deflecting device 73 may be so configured that a voltage varying in a stepwise manner is applied between the pair of deflection plates 71, as shown in FIG. 11. This allows the toner passed through the toner passage hole 31*a* to be deflected uniformly along the direction perpendicular to the advancing direction of the recording paper.

It may also be so configured that an analog voltage is applied between the deflection plates 71. In the case of an analog voltage, since the toner can be controlled, by suitably setting the analog voltage value, so as to deposit to any desired position on the recording paper shifted from the axis of the toner passage hole 31*a*, a smooth straight line diagonally extending across the advancing direction of the recording paper can be formed with toner dots.

A configuration as illustrated in FIGS. 12*a* and 12*b* may be employed to deflect the toner along a direction perpendicular to the transporting direction of the recording paper. In this case, the signal electrode 33 is split into two sectors 33*d* and 33*d* disposed along the direction perpendicular to the transporting direction of the recording paper. A pulse signal from the image information generator 50 is selectively applied to each sector 33*d* via a chopper circuit 93. As a result, when forming an image, since a pulse voltage of +100 V is applied alternately to each sector 33*d*, an electric field is alternately formed on each sector 33*d* side in the toner passage hole 31*a*, deflecting the toner passed through the toner passage hole 31*a* toward the sector 33*d*.

It will also be appreciated that each sector 33*d* of the signal electrode 33 may be further split into two or three sub sectors.

EXAMPLE 4

Figure 13:
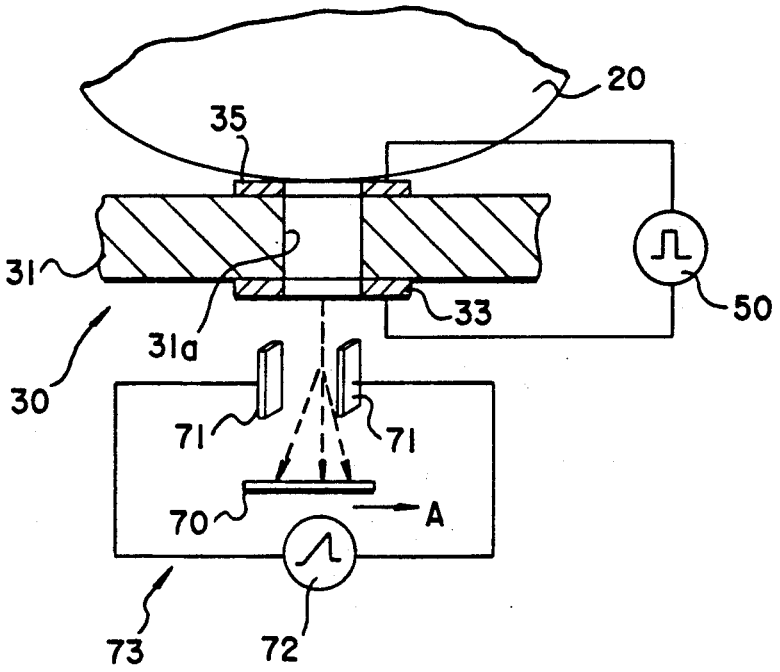
FIG. 13 is a cross sectional view showing the essential portions of an image forming apparatus according to Example 4 of the present invention.

As shown in FIG. 13, the toner deflecting device 73 may be so configured that the deflection plates 71 are disposed opposite each other suitably spaced apart along the transporting direction of the recording paper, i.e., along the axial direction of the toner feed roller 20, so as to deflect the toner along the transporting direction of the recording paper. In this case, the feeder 72 is so adapted as to periodically apply a sawtooth voltage between the two deflection plates 71.

The frequency of the sawtooth voltage is suitably set according to the transporting speed of the recording paper 70. Also, the pair of deflection plates 71 may be provided for each signal electrode 33 which is provided for each individual toner passage hole 31*a* or may be provided for a prescribed group of signal electrodes 33.

When a voltage varying in a sawtooth form is applied periodically between the two deflection plates 71 by means of the feeder 72, there occurs between the deflection plates 71 an electric field whose strength increases with time. Therefore, as the recording paper 70 advances, a larger deflection force is exerted to deflect the toner toward a position on the further downstream side of the recording paper 70 along the transporting direction thereof. As a result, the toner is applied in a concentrated manner to the advancing recording paper 70 in a short time, which serves to prevent the toner dot from deforming to an oval shape due to the advancing motion of the recording paper 70. This assures the formation of a clear image even if the transporting speed of the recording paper 70 is increased.

A configuration as illustrated in FIGS. 14*a* and 14*b* may be employed to deflect the toner along the transporting direction of the recording paper. In this case, the signal electrode 33 is split into two sectors 33*b* and 33*c* disposed along the recording paper transporting direction A. A pulse voltage, the image signal from the image information generator 50, is applied to each of the sectors 33*b* and 33*c* via a chopper circuit 94.

The chopper circuit 94 operates in such a manner as to connect the image information generator 50, for example, to the upstream side signal electrode 33*b*, to both signal electrodes 33*b* and 33*c*, and then to the downstream side signal electrode 33*c* in sequential fashion in accordance with the transporting speed of the recording paper 70. As a result, the electric field formed between the common electrode 35 and the signal electrode 33 is varied in such a manner that the toner passed through the toner passage hole 31*a* is deflected toward the upstream side along the transporting direction of the recording paper 70, is not deflected at all, and is then deflected toward the downstream side along the transporting direction in sequential fashion, thus enabling the toner to be deposited to a prescribed position on the recording paper 70 as the recording paper 70 advances.

Also, the chopper circuit 94 may be so configured as to select either the upstream side signal electrode 33*b* or the downstream side signal electrode 33*c* or both to connect to the image information generator 50, the number of times of each selection being adjusted suitably. In this case, since the amount of toner applied is adjusted according to the number of times of selection, an image having shades of tone, i.e., an image with gradations, can be produced.

EXAMPLE 5

Figure 15:
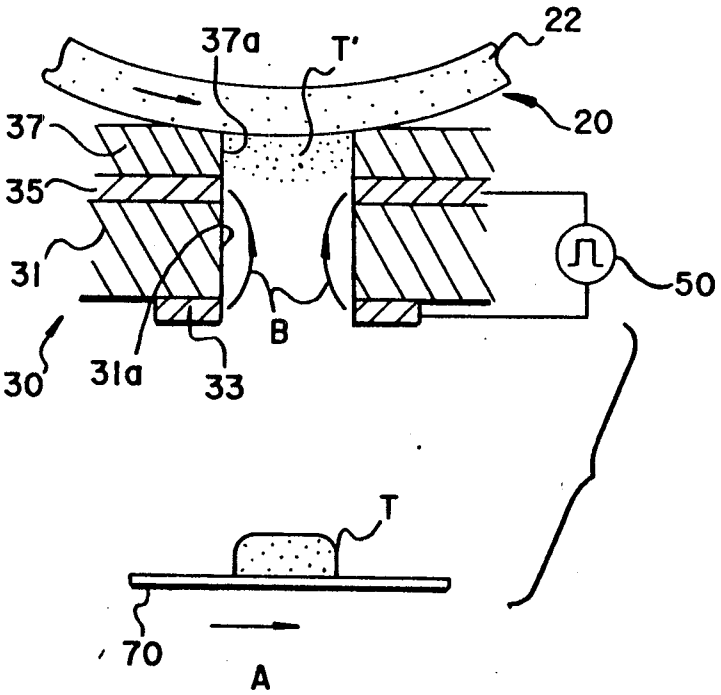
FIG. 15 is a cross sectional view showing the essential portions of an image forming apparatus according to Example 5 of the present invention.

In the example shown in FIG. 15, there is provided above the common electrode 35 an insulating member 37 having a throughhole 37*a* communicating with the toner passage hole 31*a*. The insulating member 37 is disposed in close proximity to or pressed against the sponge layer 22 of the toner feed roller 20.

In such a construction, when not forming an image, a voltage of −100 V is applied to the signal electrode 33, to form an electric field directed from the common electrode 35 toward the signal electrode 33 within the toner passage hole 31*a*. As a result, the negatively charged toner is subjected to a force exerting in arrow direction B shown in FIG. 15, causing the toner T′ to move toward the common electrode 35 and stay inside the throughhole 37*a* in the insulating member 37. The toner is held inside the throughhole 37*a* in the insulating member 37 by the electric force created within the toner passage hole 31*a*. The period during which the toner T′ is fed is approximately 5 to 30% of the entire image forming operation period. Therefore, by suitably setting the thickness of the insulating member 37, a necessary and sufficient amount of toner T′ can be held inside the throughhole 37*a* thereof. In this situation, when a voltage of +100 V is applied to the signal electrode 33 in order to form an image, the toner T′ held inside the throughhole 37*a* in the insulating member 37 is moved through the toner passage hole 31*a* and falls onto the recording paper 70, while additional toner fed from the toner feed roller 20 is also passed through the toner passage hole 31*a*. This serves to increase the amount of toner to be deposited on the recording paper 70, thereby increasing the density of the image produced. Thus, since the toner is retained inside the throughhole 37*a* in the insulating member 37 when not forming an image, the time taken to deposit a prescribed amount of toner to the recording paper 70 is reduced, contributing to increasing the image forming speed.

Figure 16:
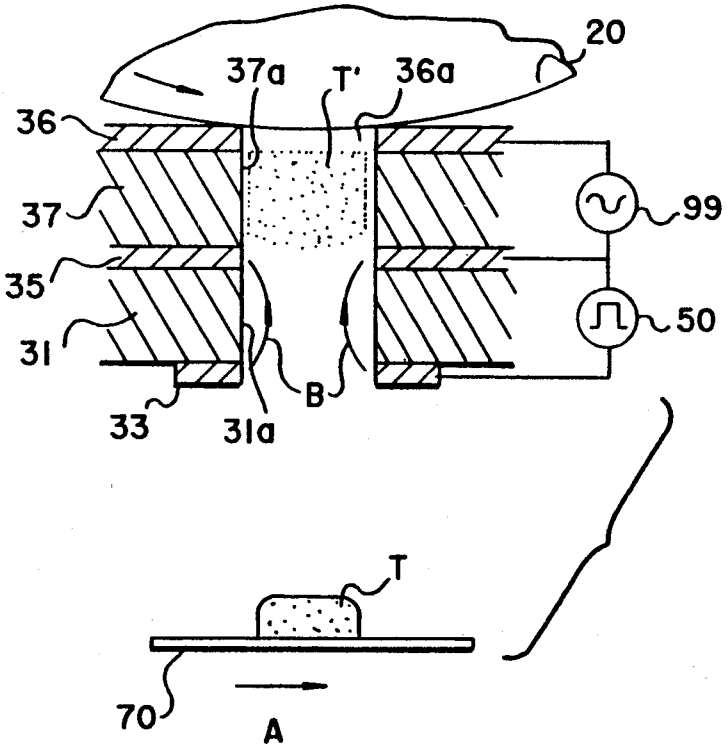
FIG. 16 is a cross sectional view showing the essential portions of another mode of Example 5 of the present invention.

Further, as shown in FIG. 16, a control electrode 36 having a throughhole 36*a* may be provided on top of the insulating member 37 disposed on the upper surface of the common electrode 35, so that an AC bias voltage is applied between the control electrode 36 and the common electrode 35 by means of an AC bias supply 99. In this configuration also, toner is held inside the throughhole 37*a* in the insulating member 37 when not forming an image, and when forming an image, the toner T' retained inside the throughhole 37*a* in the insulating member 37 is caused to fall at high speed by the bias voltage applied from the AC bias supply 99. This serves to further enhance the image forming efficiency. Also, since the toner T' retained inside the throughhole 37*a* in the insulating member 37 is caused to fall reliably by the bias voltage applied from the AC bias supply 99, there is no possibility of the toner clogging the toner passage hole 31*a*, etc., thus assuring stable formation of an image.

A DC bias supply may be used instead of the AC bias supply 99. In this case, the toner retained inside the throughhole 37*a* in the insulating member 37 can be caused to fall at a faster speed.

Furthermore, both an AC bias supply and a DC bias supply may be connected between the control electrode 36 and the common electrode 35 so that an AC bias voltage and a DC bias voltage are applied simultaneously.

EXAMPLE 6

Figure 17:
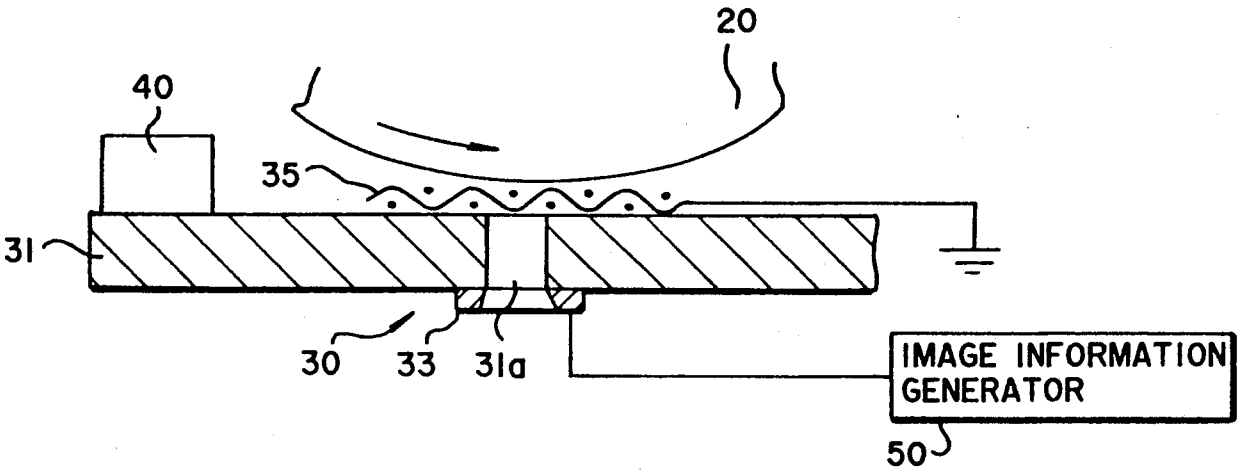
FIG. 17 is a cross sectional view showing the essential portions of an image forming apparatus according to Example 6 of the present invention.

The common electrode 35 may also be formed from a conductive metal mesh, as shown in FIG. 17. In this example, the mesh-like common electrode 35 is mounted on the insulating board 31 in such a manner as to cover the upper open ends of all the toner passage holes 31*a* in the insulating board 31. This configuration assures further reliable comminution of toner lumps fed onto the mesh-like common electrode 35.

Figure 18:
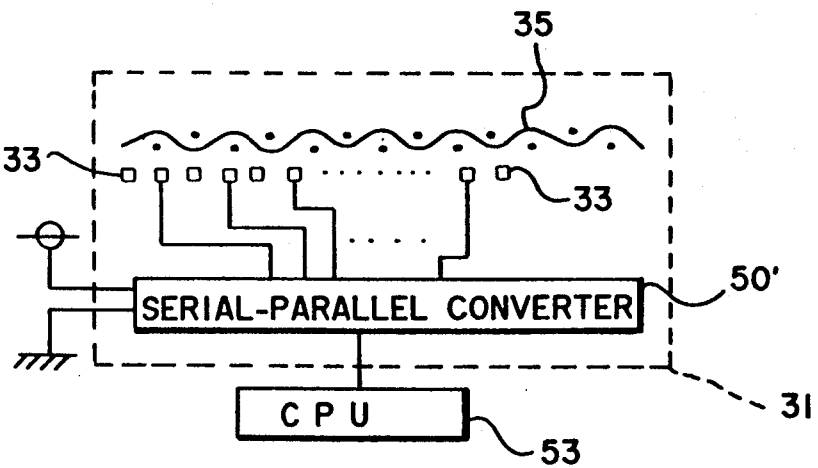
FIG. 18 is a schematic diagram showing one example of the control system thereof.

Also, when the mesh-like common electrode 35 is used, the signal electrodes 33 may be formed by etching a copper plate, as shown in FIG. 18, with a serial-parallel converter 50' being formed as an image information generator by printing a pattern on the copper plate. The serial-parallel converter 50' is controlled, for example, by a CPU 53 contained in a printer or other apparatus.

Further, as shown in FIG. 19, when the mesh-like common electrode 35 is used, each toner passage hole 31*a* may be formed in a tapered shape with its diameter increasing toward the upper open end thereof from which the toner enters. The mesh-like electrode 35 is subjected to ultrasonic vibrations generated by the ultrasonic vibration generator.

Since each toner passage hole 31*a* has a sufficiently large diameter at its upper open end, which is covered by the mesh-like common electrode 35 and from which the toner enters, as compared with its lower open end from which the toner exits, the toner passed through the mesh-like common electrode 35 flows into the toner passage hole 31*a* in a reliable manner.

As described, the toner particles are passed through the mesh-like common electrode 35 and flow into the toner passage hole 31*a* through the enlarged upper open end thereof in a reliable manner. Therefore, even if the diameter of the toner passage hole 31*a* is small at its lower open end, a sufficient amount of toner can be passed through the toner passage hole 31*a*, ensuring the formation of a high-density dot on the recording paper.

As shown in FIG. 20, the mesh-like electrode 35 may be disposed in such a manner as to be spaced apart by a prescribed distance H from the upper surface of the insulating board 31. In this case, the distance H should be set approximately equal to the thickness T of the insulating board 31. Each toner passage hole 31*b* formed in the insulating board 31 is provided with a constant inner diameter from top to bottom of the hole. The mesh-like common electrode 35 is subjected to ultrasonic vibrations generated by the ultrasonic vibration generator.

In this configuration, since the mesh-like common electrode 35 is spaced apart from the insulating board 31, the toner particles passed through the mesh-like common electrode 35 not only at portions thereof directly above the toner passage hole 31*b* formed in the insulating board 31 but also at surrounding portions thereof are allowed to flow into the toner passage hole 31*b*. Therefore, even if the diameter of each toner passage hole 31*b* is small, the toner flows into the toner passage hole 31*b* in a reliable manner. In response to the image signal from the image information generator 50, an electric field is formed between the signal electrode 33 and the mesh-like common electrode 35 in such a manner as to allow the negatively charged toner to pass through the toner passage hole 31*b*, which causes the toner entering the toner passage hole 31*b* to fall down the toner passage hole 31*b*. As a result, a large amount of toner is passed through the restricted toner passage hole 31*c*, preventing the density of the image produced from dropping.

Furthermore, it may be so configured that, as shown in FIG. 21, a planar common electrode 35 is disposed in contacting relationship to the upper surface of the insulating board 31 while a mesh electrode 58 is disposed above the common electrode 35 and spaced apart therefrom by a prescribed distance H', with an alternating current generator 54 provided between the common electrode 35 and the mesh electrode 58. In this case, the distance H' between the mesh electrode 58 and the common electrode 35 should be set approximately equal to the combined thickness T' of the insulating board 31 and the common electrode 35. An alternating current whose polarity is alternately reversed, for example, an AC current, is applied between the common electrode 35 and the mesh electrode 58 by means of the alternating current generator 54. The alternating current generator 54 may be adapted either to apply a DC alternating current or to apply an alternating current combining DC and AC. In this example, the mesh electrode 58 is subjected to the ultrasonic vibrations generated by the ultrasonic vibration generator.

In this example, the negatively charged toner fed onto the mesh electrode 58 and passed therethrough is subjected to vibration between the mesh electrode 58 and the common electrode 35 because of the alternating current applied therebetween by the alternating current generator 54. In this situation, when an electric field is formed between the common electrode 35 and the signal electrode 33 in response to the image signal from the image information generator 50, the negatively charged toner being vibrated above the common electrode 35 is attracted by the electric field to flow into the throughhole 35*a* in the common electrode 35, pass through the toner passage hole 31*b* and the throughhole 33*a* in the signal electrode 33, and fall onto the base electrode 60. At this time, since the toner positioned above the throughhole 35*a* in the common electrode 35 is subjected to vertical vibrations, the amount of toner flowing into the throughhole 35*a* in the common electrode 35 is increased. Therefore, even if the toner passage hole 31*b* formed in the insulating board 31 is reduced in diameter, a sufficient amount of toner is passed through the toner passage hole 31*a* without being obstructed by the mesh electrode 58, thus achieving formation of a high-density image.

As shown in FIG. 22, the signal electrodes 33 provided on the underside of the insulating board 31 may also be formed from conductive mesh, and further, a conductive board 31 may be used instead of the insulating board 31. In this case, an insulating member 57 is provided, for example, between each signal electrode 33 and the conductive board 31.

The sieve opening of the upper side mesh-like common electrode 35 should be set preferably within the range of 50 to 300 μm, and the sieve opening of the lower side mesh-like signal electrode 33 should be set to a larger size than that of the upper side mesh-like common electrode 35.

Tailored mesh, etching mesh, etc., formed from metals such as nickel, stainless, aluminum, copper, silver, etc. or from conductive resins, are usually used for make mesh-like electrodes.

EXAMPLE 7

Figure 23:
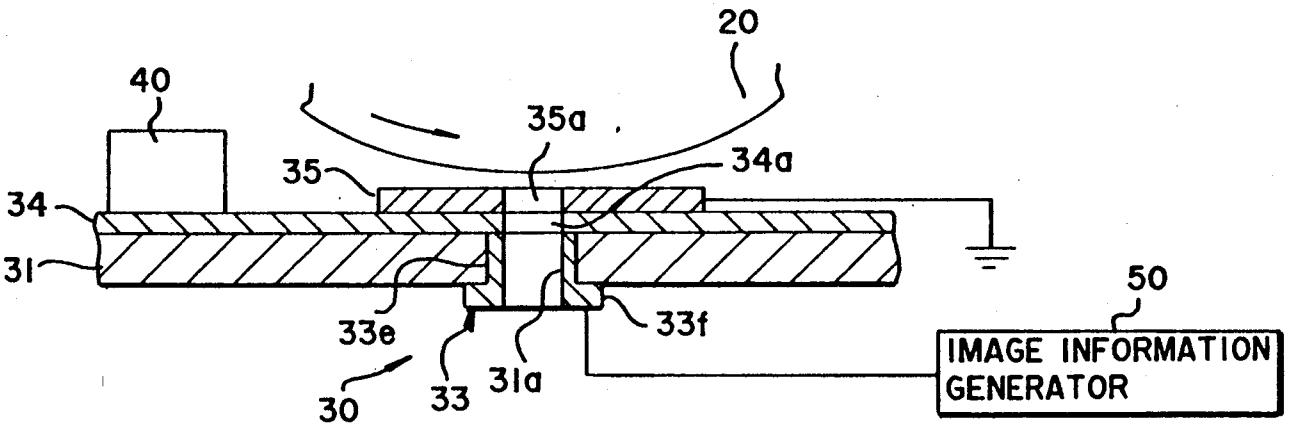
FIG. 23 is a cross sectional view showing the essential portions of an image forming apparatus according to Example 7 of the present invention.

The example shown in FIG. 23 has a toner controller 30 comprising a first insulating board 31 mounted in a horizontal position and a second insulating board 34 mounted on top of the first insulating board 31. The first insulating board 31 and the second insulating board 34 are provided with numerous pinhole-like toner passage holes 31*a* and 34*a* passing across the thickness thereof, the toner passage holes 31*a* and 34*a* being aligned with each other.

On the upper surface of the second insulating board 34, there is provided a common electrode 35 having numerous throughholes 35*a* passing through the thickness thereof and having the same diameter as that of the toner passage holes 34*a*. The common electrode 35 is mounted on the second insulating board 34 in such a manner that the throughholes 35*a* are aligned with the respective toner passage holes 34*a* formed in the second insulating board 34. On the other hand, there are provided counter electrodes 33 one for each toner passage hole 31*a* in the lower side insulating board 31. Each counter electrode consists of a cylindrically shaped body 33*e* that is fitted into the corresponding toner passage hole 31*a* in the first insulating board 31 and a flange portion 33*f* extending downwardly from the toner passage hole 31*a* and contacting on the underside of the first insulating board 31.

The common electrode 35 mounted on the second insulating board 34 is grounded. Also, each of the counter electrodes 33 provided in the first insulating board 31 is connected to the image information generator 50 which supplies an electrical signal to each counter electrode 33.

The toner controller 30 of the above construction is produced in the following manner, for example. After forming the numerous toner passage holes 31*a* in the first insulating board 31, the counter electrodes 33 are formed in the respective toner passage holes 31*a* by plating. Then, the second insulating board 34 in which the numerous toner passage holes 34*a* have been formed are bonded to the first insulating board 31, after which the common electrode 35 is bonded to the second insulating board 34.

Since the body 33*e* of each counter electrode 33 is fitted into the corresponding lower toner passage hole 31*a*, when a voltage is applied from the image information generator 50 to the counter electrode 33, an electric field is generated from the entire body 33*e*, the effect of the electric field thoroughly reaching the axis of the toner passage holes 31*a* and 34*a*. As a result, the toner particles fed from the toner feed roller 20 and broken up by the ultrasonic vibrations applied from the ultrasonic vibration generator 40 are thoroughly controlled by the electric field formed in the toner passage holes 31*a* and 34*a*. Therefore, there is no need to increase the potential difference between the counter electrode 33 and the common electrode 35.

In the above example, each counter electrode 33 is provided with a cylindrically shaped body 33*e* that is fitted into the corresponding toner passage hole 31*a* in the first insulating board 31, but alternatively, the common electrode 35 may be provided with cylindrical portions which are fitted into the respective toner passage holes 34*a* in the second insulating board 31. Further, both the electrodes 33 and 35 may be provided with cylindrical portions which are fitted into toner passage holes 31*a* and 34*a*, respectively.

Figure 24:
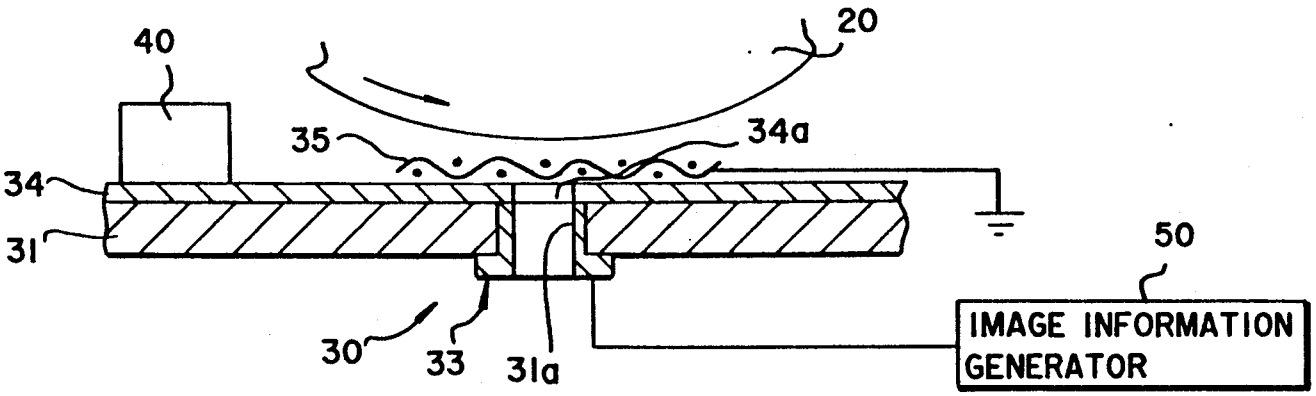
FIG. 24 is a cross sectional view showing the essential portions of another mode of Example 7 of the present invention.

Patterns of copper foil, silver foil, aluminum, etc. are suitably used for making the common electrode 35 and the signal electrodes 33. Also, as shown in FIG. 24, the common electrode 35 may be formed from a conductive metal mesh. The mesh-like common electrode 35 is mounted on the insulating board 31 in such a manner as to cover the upper open ends of all the toner passage holes 34*a* formed in the second insulating board 34. This configuration assures further reliable comminution of toner lumps fed onto the mesh-like common electrode 35.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An image forming apparatus comprising:

toner control means including a board having at least one toner passage hole and a pair of electrodes disposed insulated from each other across the board to form an electric field within the at least one toner passage hole and having throughholes aligned in a communicating relationship with corresponding toner passage holes;

ultrasonic vibration generating means for applying ultrasonic vibrations to the board; and image information generating means for providing, in accordance with image information, a potential difference between the pair of electrodes of the toner control means to form within the at least one toner passage hole an electric field exerting a force at least in a toner passing direction, wherein a relationship of a diameter a of the toner passage hole relative to a combined axial length b of 1) an axial length of the at least one toner passage hole and 2) an axial length of the throughholes in the pair of electrodes satisfies a condition of $5a \geqq b$.

2. An image forming apparatus according to claim 1, further comprising a base electrode which is disposed on a toner exit side of the at least one toner passage hole in the toner control means and on an upper surface of which a recording paper is transported in a prescribed direction, the base electrode, together with the electrode disposed on a toner entry side of the toner control means, serving to form said electric field exerting said force in the toner passing direction, wherein a distance c between the base electrode and the electrode on the toner exit side of the toner control means satisfies a condition of $10a \geqq c$ with respect to the at least one toner passage hole.

3. An image forming apparatus according to claim 1, wherein the board is an insulating board.

4. An image forming apparatus according to claim 3, wherein the board is formed from a glass fiber reinforced epoxy resin.

5. An image forming apparatus according to claim 3, wherein the board is formed from a photosensitive polymer.

6. An image forming apparatus according to claim 3, wherein the board is formed from polyimide.

7. An image forming apparatus according to claim 2, further comprising voltage adjusting means for adjusting voltage applied to the base electrode.

8. An image forming apparatus according to claim 1, further comprising toner feed means for feeding toner charged with prescribed polarity to the toner control means.

9. An image forming apparatus according to claim 8, wherein the toner feed means is a sponge roller including a conductive metal roller part and a sponge layer fitted around an outer circumferential surface of the conductive metal roller part.

10. An image forming apparatus according to claim 9, wherein the conductive metal roller part of the sponge roller is charged with a same polarity as that of the charged toner supplied to the toner feed means.

11. An image forming apparatus according to claim 1, further comprising vibration strength adjusting means for adjusting a strength of vibrations that the ultrasonic vibration generating means generates.

12. An image forming apparatus according to claim 1, wherein the ultrasonic vibration generating means is operated when an image forming operation is not performed.

13. An image forming apparatus according to claim 1, wherein the board is supported, at a side edge thereof opposite portions of the toner passage holes from a side edge where the ultrasonic vibration generating means is mounted, by means of a prescribed supporting member with an elastic member interposed therebetween.

14. An image forming apparatus according to claim 1, wherein the ultrasonic vibration generating means is coupled to the board by means of a vibrating member formed from a material having good ultrasonic transmissibility.

15. An image forming apparatus according to claim 1, further comprising output time adjusting means for adjusting a time during which a prescribed potential is provided between the pair of electrodes of the toner control means in response to the output of the image information generating means.

16. An image forming apparatus according to claim 1, further comprising signal potential adjusting means for adjusting signal potential applied between the pair of electrodes of the toner control means by the image information generating means.

17. An image forming apparatus according to claim 2, wherein the toner passage holes are provided in plural numbers and arranged in a plurality of arrays extending in a direction perpendicular to an advancing direction of the recording paper, the toner passage holes in each array overlapping each other in the advancing direction of the recording paper

18. An image forming apparatus according to claim 1, further comprising means for increasing a potential difference between the pair of electrodes of the toner control means when a signal to form an image is issued, as well as when a signal not to form an image is issued, from the image information generating means.

19. An image forming apparatus according to claim 7, wherein the voltage adjusting means for the base electrode is controlled according to a signal to form an image and a signal not to form an image issued from the image information generating means.

20. An image forming apparatus according to claim 9, further comprising means for applying one potential to the conductive metal roller part of the sponge roller when a signal to form an image is issued, and another potential thereto when a signal not to form an image is issued from the image information generating means.

21. An image forming apparatus according to claim 2, further comprising toner deflecting means disposed between the toner control means and the base electrode for deflecting the toner passed through the at least one toner passage hole toward a prescribed direction.

22. An image forming apparatus according to claim 21, wherein the toner deflecting means deflects the toner toward a direction perpendicular to an advancing direction of recording paper.

23. An image forming apparatus according to claim 22, wherein the toner deflecting means includes a pair of electrodes disposed opposite to each other along the direction perpendicular to the advancing direction of the recording paper and means for applying to the pair of electrodes a voltage varying in a pulse-like manner.

24. An image forming apparatus according to claim 22, wherein the toner deflecting means includes a pair of electrodes disposed opposite to each other along the direction perpendicular to the advancing direction of the recording paper and means for applying to the electrodes a voltage varying in a stepwise manner.

25. An image forming apparatus according to claim 22, wherein the toner deflecting means comprises a chopper circuit for applying a pulse voltage to a signal electrode which is split into two paired sectors along the direction perpendicular to the advancing direction of the recording paper.

26. An image forming apparatus according to claim 21, wherein the toner deflecting means deflects the toner toward a same direction as the advancing direction of the recording paper.

27. An image forming apparatus according to claim 26, wherein the toner deflecting means includes a pair of electrodes disposed opposite to each other along the advancing direction of the recording paper and means for applying to the pair of electrodes a voltage varying in a sawtooth form.

28. An image forming apparatus according to claim 27, wherein the toner deflecting means comprises a chopper circuit for applying a pulse voltage to a signal electrode which is split into two paired sectors along the advancing direction of the recording paper.

29. An image forming apparatus according to claim 1, wherein the toner entry side electrode of the toner control means is provided with an insulating member on a surface thereof close to the toner feed means.

30. An image forming apparatus according to claim 29, wherein the insulating member is provided with an electrode mounted on the surface thereof close to the toner feeding means and an alternating voltage is applied between the electrodes disposed opposite to each other across the insulating member.

31. An image forming apparatus according to claim 1, wherein, of the pair of electrodes disposed opposite each other across the board, the toner entry side electrode is a mesh-like electrode.

32. An image forming apparatus according to claim 1, wherein the pair of electrodes disposed opposite to each other across the board are mesh-like electrodes.

33. An image forming apparatus according to claim 31, wherein the toner passage holes are each formed in a tapered shape becoming wider toward an open end thereof from which the toner enters.

34. An image forming apparatus according to claim 31, wherein the mesh-like electrode is disposed suitably spaced apart from the board.

35. An image forming apparatus according to claim 1, wherein, in addition to the pair of electrodes disposed opposite to each other across the board, a mesh electrode is disposed above the toner entry side electrode with a suitable space provided therebetween and an alternating current is applied to the mesh electrode.

36. An image forming apparatus according to claim 1, wherein at least one of the pair of electrodes disposed opposite to each other across the board is formed in a cylindrical shape fitted into the at least one toner passage hole.

37. An image forming apparatus according to claim 36, wherein the board includes a pair of insulating boards stacked one on top of another and the cylindrically shaped electrode is fitted into the at least one toner passage hole in only one of the insulating boards.

38. An image forming apparatus according to claim 36, wherein another of the pair of electrodes is a mesh-like electrode.

* * * * *